US010788785B2

(12) United States Patent
Kondo

(10) Patent No.: US 10,788,785 B2
(45) Date of Patent: Sep. 29, 2020

(54) DOCUMENT COVER CLOSER AND OFFICE EQUIPMENT HAVING THE SAME

(71) Applicant: KEM HONGKONG LIMITED, Kowloon (HK)

(72) Inventor: Tetsuo Kondo, Kanagawa (JP)

(73) Assignee: KEM HONGKONG LIMITED, Kowloon (HK)

( * ) Notice: Subject to any disclaimer, the term of this patent is extended or adjusted under 35 U.S.C. 154(b) by 0 days.

(21) Appl. No.: 16/114,630

(22) Filed: Aug. 28, 2018

(65) Prior Publication Data

US 2019/0094791 A1 Mar. 28, 2019

(30) Foreign Application Priority Data

Aug. 29, 2017 (JP) ..... 2017-164238

(51) Int. Cl.
*G03G 21/16* (2006.01)
*E05F 1/10* (2006.01)
*E05F 3/20* (2006.01)

(52) U.S. Cl.
CPC ..... *G03G 21/1633* (2013.01); *E05F 1/105* (2013.01); *E05F 3/20* (2013.01); *E05Y 2900/60* (2013.01)

(58) Field of Classification Search
CPC ... G03G 21/1633; G03G 15/605; E05F 1/105; E05F 3/20; E05Y 2900/60; E05Y 2201/638; H04N 1/00554
See application file for complete search history.

(56) References Cited

U.S. PATENT DOCUMENTS 4,588,290 A * 5/1986 Ohtsuka ..... G03B 27/6228 355/76
6,415,477 B1 * 7/2002 Hosaka ..... E05F 1/1261 16/284

(Continued)

FOREIGN PATENT DOCUMENTS

JP 2011-139317 A 7/2011

*Primary Examiner* — Victor D Batson
*Assistant Examiner* — Matthew J Sullivan
(74) *Attorney, Agent, or Firm* — Notaro, Michalos & Zaccaria P.C.

(57) ABSTRACT

An object of the invention is to provide a document cover closer as well as office equipment having such a document cover closer, wherein it is possible to finely adjust a spring force and to set its adjusting range within a wide range, as well as to downsize the apparatus.

To achieve the above-mentioned object, in a document cover closer 5 according to the invention, a supporting part 20 is rotatably attached to an attaching part 10 being a base via a first hinge pin 81, and a lift part 30 to which the document cover is fixed is rotatably attached to the supporting part 20. In an elastic force adjusting portion 60, as the document cover is opened and the supporting part 20 is erected, the spring force adjusting screw 80 extending perpendicular to an axial direction of the first hinge pin 81 is rotated; then, as the spring force adjusting cam plate 61 moves in a forward and backward direction along cam tracks of cam surfaces 52L, 52R extending along a forward and backward direction of the second spring receiving portion 42, a spring sheet plate 70 as well moves integrally to compress or expand a first coil spring 43 and the second coil spring 44 to adjust a spring force.

5 Claims, 15 Drawing Sheets

(56) References Cited

U.S. PATENT DOCUMENTS

| | | | | |
|---|---|---|---|---|
| 6,928,698 | B2 * | 8/2005 | Chen | E05D 3/18 16/277 |
| 7,617,568 | B2 * | 11/2009 | Jing | E05F 1/1276 16/239 |
| 9,207,616 | B2 * | 12/2015 | Kumazawa | G03G 15/605 |
| 9,986,116 | B2 * | 5/2018 | Okazawa | E05D 11/0054 |
| 10,306,087 | B2 * | 5/2019 | Choi | H04N 1/00519 |
| 10,397,419 | B2 * | 8/2019 | Tsuchiya | G03G 21/1633 |
| 10,443,285 | B2 * | 10/2019 | Fang | E05D 3/02 |
| 2007/0089271 | A1 * | 4/2007 | Jo | E05D 11/1064 16/286 |
| 2007/0251056 | A1 * | 11/2007 | Aoyagi | G03G 15/60 16/221 |
| 2011/0176124 | A1 * | 7/2011 | Takata | G03G 15/605 355/75 |
| 2015/0067986 | A1 * | 3/2015 | Lee | E05F 1/1261 16/321 |
| 2018/0196385 | A1 * | 7/2018 | Kondo | H04N 1/00554 |
| 2018/0347247 | A1 * | 12/2018 | Kondo | E05F 1/1253 |
| 2019/0302675 | A1 * | 10/2019 | Nishizawa | B65H 5/064 |

* cited by examiner 72
72a
426L
84
80b
80a
65
80
65a
422
73
62a
50a
61
42
425
42a
60
424
70
50
66L
51L
64L
423
413
40
52L
44
43
41a
41
416
413b
415
415b
415a
415c
83
Z
(F)
Y (R)

DOCUMENT COVER CLOSER AND OFFICE EQUIPMENT HAVING THE SAME

FIELD OF THE INVENTION

The invention relates to a document cover closer suitable in use for openably and closably attaching a document cover mounted on various sorts of office equipment, such as copying machine, printer, facsimile and scanner, to an office equipment main body; the invention also relates to office equipment equipped with such a document cover closer.

A document cover for openably and closably covering an upper surface of a contact glass (document glass) provided on an upper portion of a main body is disposed in a variety of office equipment, such as copying machine, printer, facsimile and scanner, which has function of reading documents. The document cover is attached to the main body via a document cover closer composed of a pair of hinge devices provided on the right and left toward a rear portion of an upper surface of the main body, such that it is possible to open the document cover from a front side of the main body.

In a document cover closer, an urging portion composed of coil springs, etc. for applying an urging force in an opening direction of the document cover is provided during an opening and closing operation of the document cover, in order to make it possible to open and close the document cover using a slight operation force. Still further, the urging portion has a free stop function for stopping a rotation in a closing direction by the document cover or its own weight and maintaining the document cover at the position as it stops, even if the user has his hands off the document cover within a predetermined angle (aperture) range during an opening and closing operation of the document cover.

In an urging portion, the free stop function is reduced due to changes over time. To this end, a spring force adjusting portion for a spring force of an urging portion is provided on the document cover closer (JP Laid-Open Patent Application No. 2011-139317).

In a spring force adjusting portion, when a disc-shaped adjusting plate constituting a rotatable spring seat is rotated around an axial direction of a coil spring of the urging portion being an axis of rotation, it moves along cam surfaces of cam portions toward the axis of rotation and changes a total length of coil springs to adjust a spring force. The adjusting plate is coupled to a moving piece screwing forward on a screw shaft disposed along a forward and backward direction of the main body. When the screw shaft is rotated using jig such as hexagonal wrench from a front surface side, the adjusting plate is rotated as well via the moving piece screwing forward.

SUMMARY OF THE INVENTION

An object of the invention is to provide a document cover closer as well as office equipment having such a document cover closer, wherein a mechanism of a spring force adjusting portion is further developed, so that it is possible to finely adjust a spring force and set its adjusting range within a wide range.

The first aspect of a document cover closer to achieve the object of the invention is a document cover closer for openably and closably attaching a document cover to a main body, characterized in that the document cover closer comprises:

an attaching member comprising a bottom plate portion attached to the main body, as well as a right side plate and a left side plate provided on both sides of the bottom plate portion;

a supporting member comprising a main body plate portion, a right side plate and a left side plate provided by bending the main body plate portion downward from its both side portions, as well as a right guide plate portion and a left guide plate portion provided by bending the right side plate and the left side plate inward from their respective lower end portions, the right side plate and the left side plate being rotatably attached to the right side plate and the left side plate of the attaching member via a first hinge pin;

a lift member for holding said document cover, which comprises a main body plate portion, a right side plate and a left side plate provided downward from its both side portions, as well as a right attaching plate portion and a left attaching plate portion provided outward from lower end portions of the right side plate and the left side plate, the right side plate and the left side plate being attached to the right side plate and the left side plate of the attaching member on the side of their respective free ends via a second hinge pin, such that the lift member is rotatable in a direction opposite to the rotational direction of said supporting member;

a first spring receiving portion in contact with a first pressure receiving member attached between the right side plate and the left side plate of the attaching member and slidably provided between the right side plate and the left side plate of the supporting member;

a second spring receiving portion comprising a second spring receiving hole in contact with a second pressure receiving member attached at a position at which the lift member swivels about a second hinge pin and slidably attached between the right side plate and the left side plate of the supporting member; an elastic member provided between said first spring receiving portion and said second spring receiving portion;

a spring force adjusting portion of the elastic member provided on said second spring receiving portion;

wherein the spring force adjusting portion comprises:

a pair of cam portions respectively having a cam surface tilted in one direction and provided on both sides of the second spring receiving hole of the second spring receiving portion;

a spring force adjusting plate having sliding cam plate portions in contact with respective cam portions on both sides, wherein the spring force adjusting plate is slidably provided toward an upper portion from an upper wall opening, wherein a screw screwing piece with a screw hole provided on one end is provided on a top portion of the second spring receiving portion;

a spring sheet plate having an adjusting screw attaching hole on one end and overlapping the screw screwing piece to protrude upward from the upper wall opening, wherein the spring sheet plate is provided to overlap the elastic member in contact with the latter on a lower surface of the spring force adjusting plate; and a spring force adjusting screw for adjusting sliding width of the spring force adjusting plate, wherein the spring force adjusting screw is attached to an adjusting screw hole and screwed to a screw hole of the spring force adjusting plate.

The second aspect of a document cover closer to achieve the object of the invention is a document cover closer for openably and closably attaching a document cover to a main body, characterized in that the document cover closer comprises:

an attaching member comprising a bottom plate portion attached to the main body and right side plate and left side plate provided on both sides of the bottom plate portion;

a supporting member comprising a main body plate portion, a right side plate and a left side plate provided by bending the main body plate portion downward from its both side portions, as well as a right guide plate portion and a left guide plate portion provided by bending the right side plate and the left side plate inward from their respective lower end portions, the right side plate and the left side plate being rotatably attached to the right side plate and the left side plate of the attaching member via a first hinge pin;

a lift member for holding said document cover, which comprises a main body plate portion, a right side plate and a left side plate provided downward from its both side portions, as well as a right attaching plate portion and a left attaching plate portion provided outward from lower end portions of the right side plate and the left side plate, the right side plate and the left side plate being attached to the right side plate and the left side plate of the attaching member on the side of their respective free ends via a second hinge pin, such that the lift member is rotatable in a direction opposite to the rotational direction of said supporting member;

a first spring receiving portion in contact with a first pressure receiving member attached between the right side plate and the left side plate of the attaching member and slidably provided between the right side plate and the left side plate of the supporting member;

a second spring receiving portion comprising a second spring receiving hole in contact with a second pressure receiving member attached at a position at which the lift member swivels about a second hinge pin and slidably attached between the right side plate and the left side plate of the supporting member, and a damper attaching protruding portion provided to protrude on an inner top portion of the second spring receiving hole; an elastic member provided between said first spring receiving portion and said second spring receiving portion;

a damper housed in said elastic member and provided between the first spring receiving portion and said second spring receiving portion, the damper starting to function from a predetermined closing angle of the document cover closer; a spring force adjusting portion of the elastic member provided on the second spring receiving portion;

wherein the spring force adjusting portion comprises:

a pair of cam portions respectively having at least a cam surface tilted in one direction and provided on both sides of the second spring receiving hole of the second spring receiving portion;

a spring force adjusting plate having sliding cam plate portions in contact with respective cam portions on both sides, wherein the spring force adjusting plate is slidably provided toward an upper portion from an upper wall opening, wherein a screw screwing piece with a screw hole provided on one end is provided on a top portion of said second spring receiving portion, wherein the spring force adjusting plate further comprises a guide hole into which said damper attaching protruding portion is inserted;

a spring sheet plate having an adjusting screw attaching hole on one end and a screw holding piece overlapping said screw screwing piece to protrude upward from said upper wall opening, as well as a hole portion into which the damper attaching protruding portion is inserted, wherein the spring sheet plate is provided to overlap said elastic member in contact therewith on a lower surface of said spring force adjusting plate; and a spring force adjusting screw for adjusting sliding width of the spring force adjusting plate, wherein the spring force adjusting screw is attached to an adjusting screw hole and screwed to a screw hole of the spring force adjusting plate.

The third aspect of the document cover closer to achieve an object of the invention is characterized in that the spring force adjusting portion is provided on a first spring receiving portion.

The third aspect of the document cover closer to achieve an object of the invention is characterized in that the cam portions are formed in a right and left direction inside the first spring receiving portion or the first spring receiving portion to face each other, wherein the spring force adjusting cam plate comprises a pair of sliding cam plate portions on the right and left each having a sliding surface which respectively slides on each of cam surfaces of the pair of sliding cam plate portions on the right and left, wherein the spring sheet plate is disposed between the pair of sliding cam plate portions on the right and left. Office equipment to achieve an object of the invention is the fifth aspect and comprises a contact glass provided on a main body, on which a document is put, a document cover for openably and closably covering the contact glass, and a document cover closer according to one of the above-described aspects for attaching the document cover to the main body.

According to the first and the second aspects of the invention, a spring force adjusting cam plate moves along the cam trajectory of a linear cam portion in parallel to an elastic force adjusting screw to allow for a setting of a longer movement distance of the spring force adjusting cam plate, so that an elastic force can be finely adjusted over a wide range. Moreover, an adjustment of an elastic force of an urging portion can be realized by screwing an elastic force adjusting screw while a document cover is opened.

According to the third aspect of the invention, cam portions of the spring force adjusting portion can be provided using a first elastic member receiving portion and a second elastic member receiving portion, so that a document cover closer can be downsized.

According to the fourth aspect of the invention, a movement of a spring force adjusting cam plate can be realized with a simple structure.

According to the fifth aspect of the invention, a document cover closer can be downsized, so that a section around a contact glass of a main body to which the document cover closer is attached can have a neat design.

EMBODIMENTS

Figure 1:
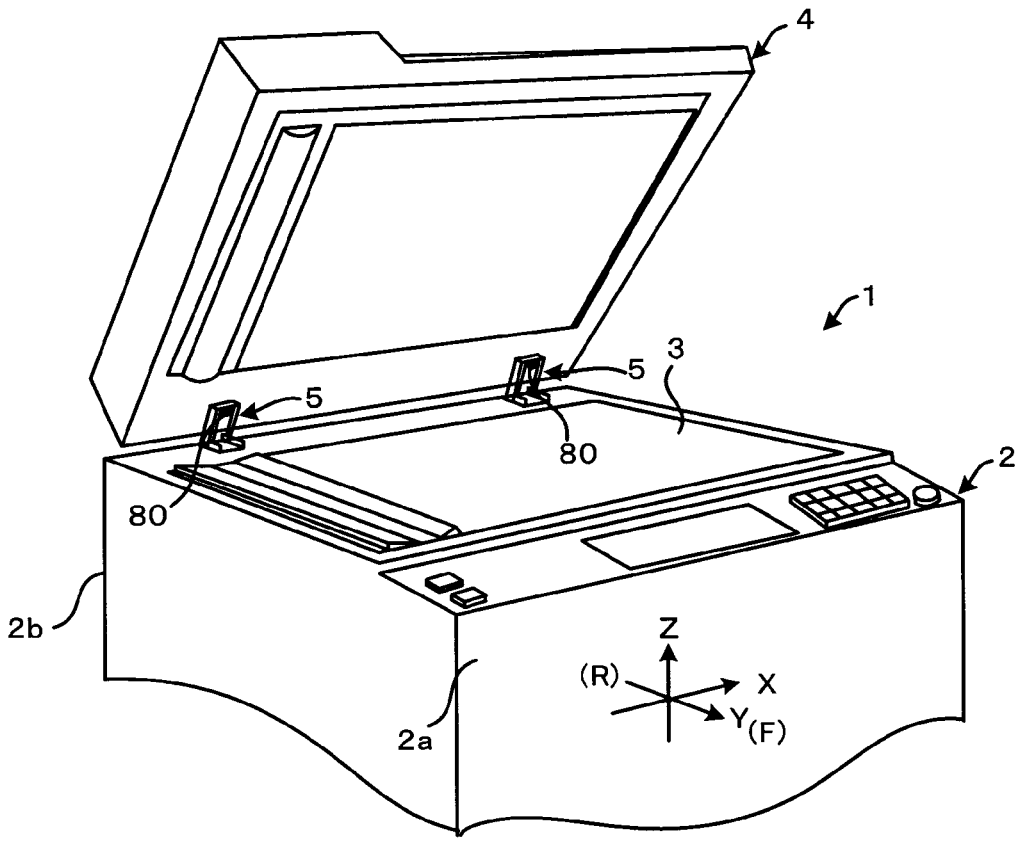
FIG. 1 shows a schematic perspective view of exterior appearance illustrating an embodiment of a copying machine equipped with a document cover closer according to the invention.

In the following, the invention is described in detail based on embodiments shown in the drawings.

Figure 2:
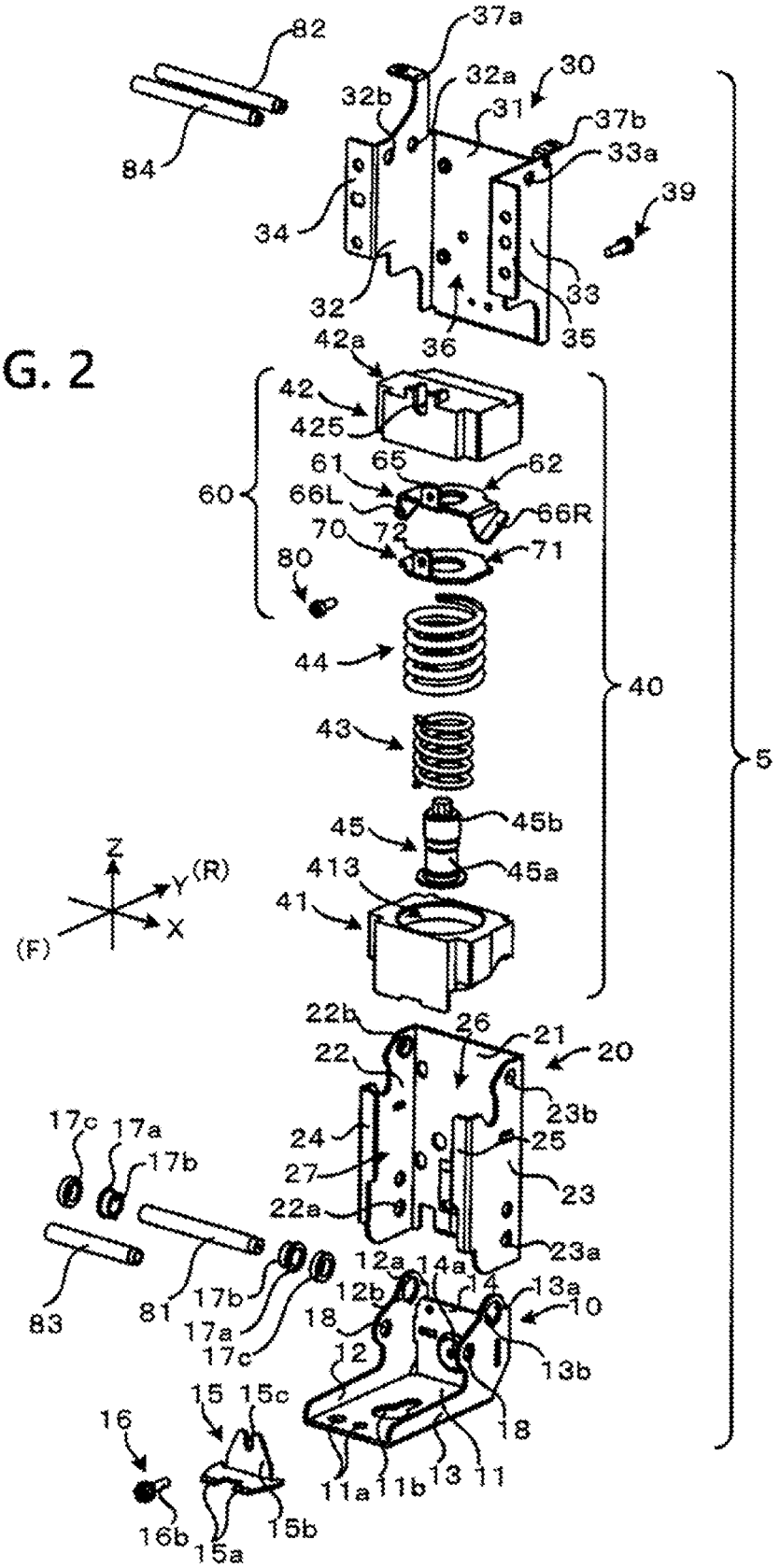
FIG. 2 shows an exploded perspective view illustrating an embodiment of a document cover closer for the left-hand side, as shown in FIG. 1.
Figure 3:
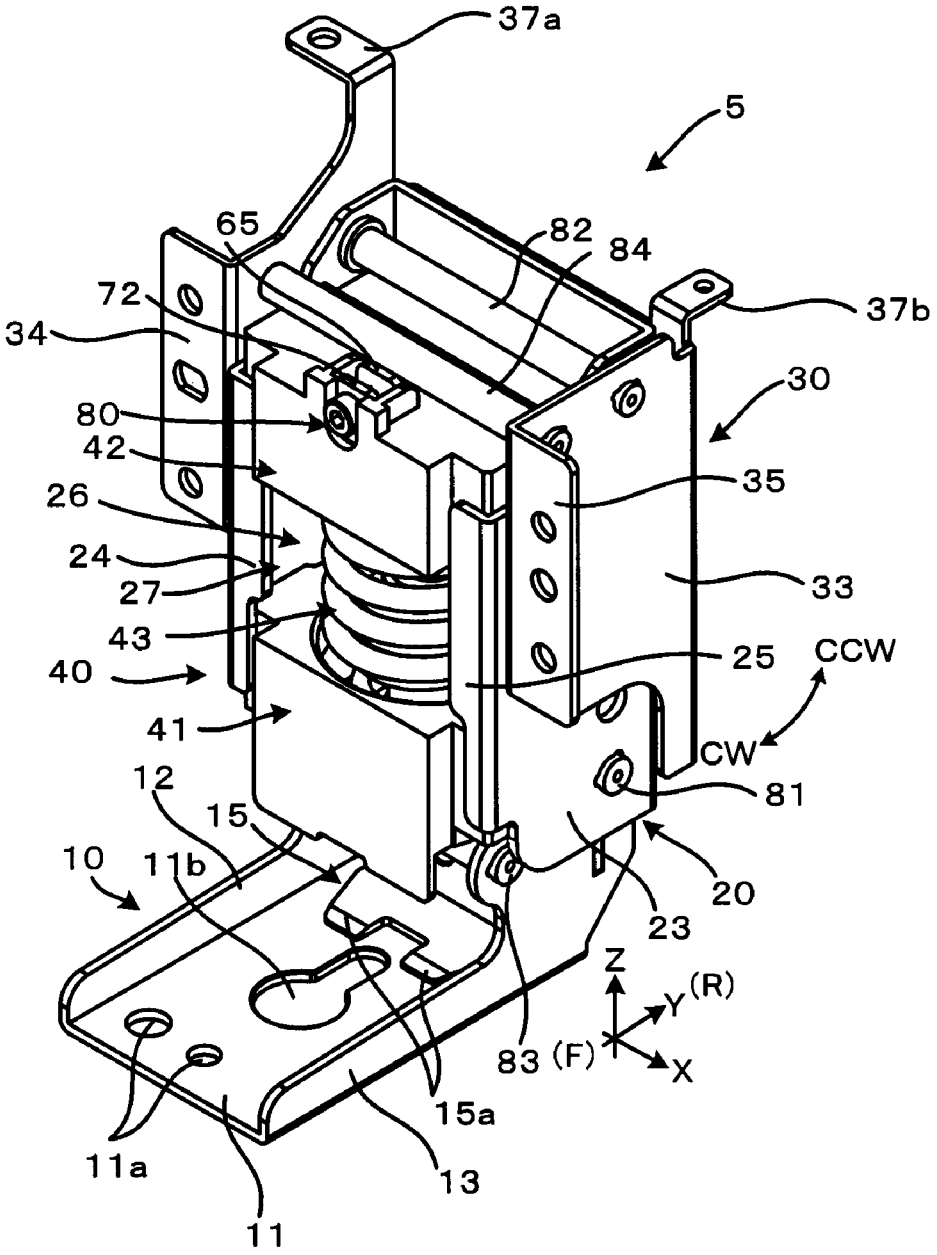
FIG. 3 shows a perspective view of exterior appearance illustrating a document cover closer (in an assembled state) as shown in FIG. 2, in a fully-opened state.
Figure 4:
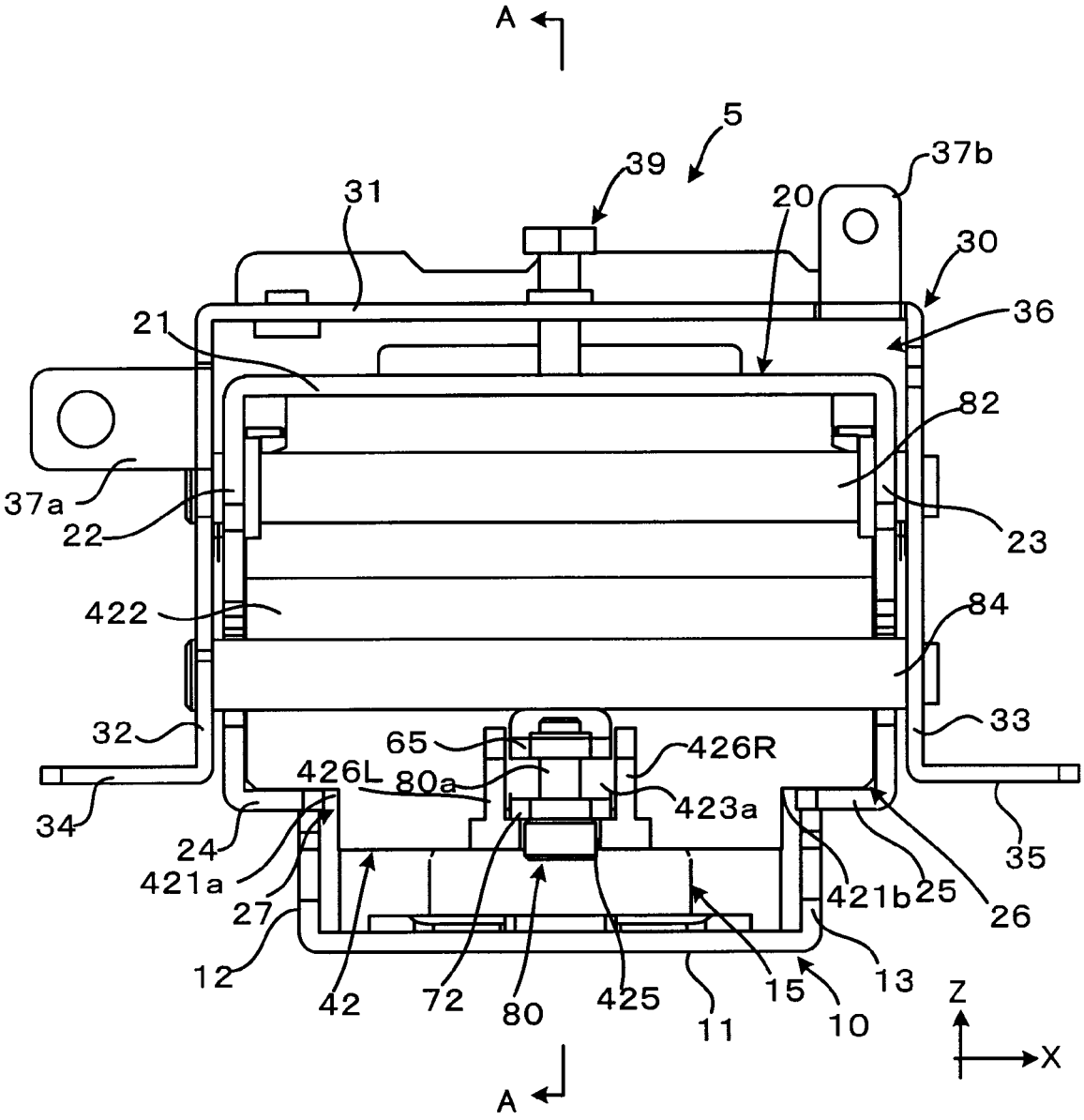
FIG. 4 shows an elevation view illustrating a document cover closer (in an assembled state) as shown in FIG. 2, in a fully-closed state.
Figure 5:
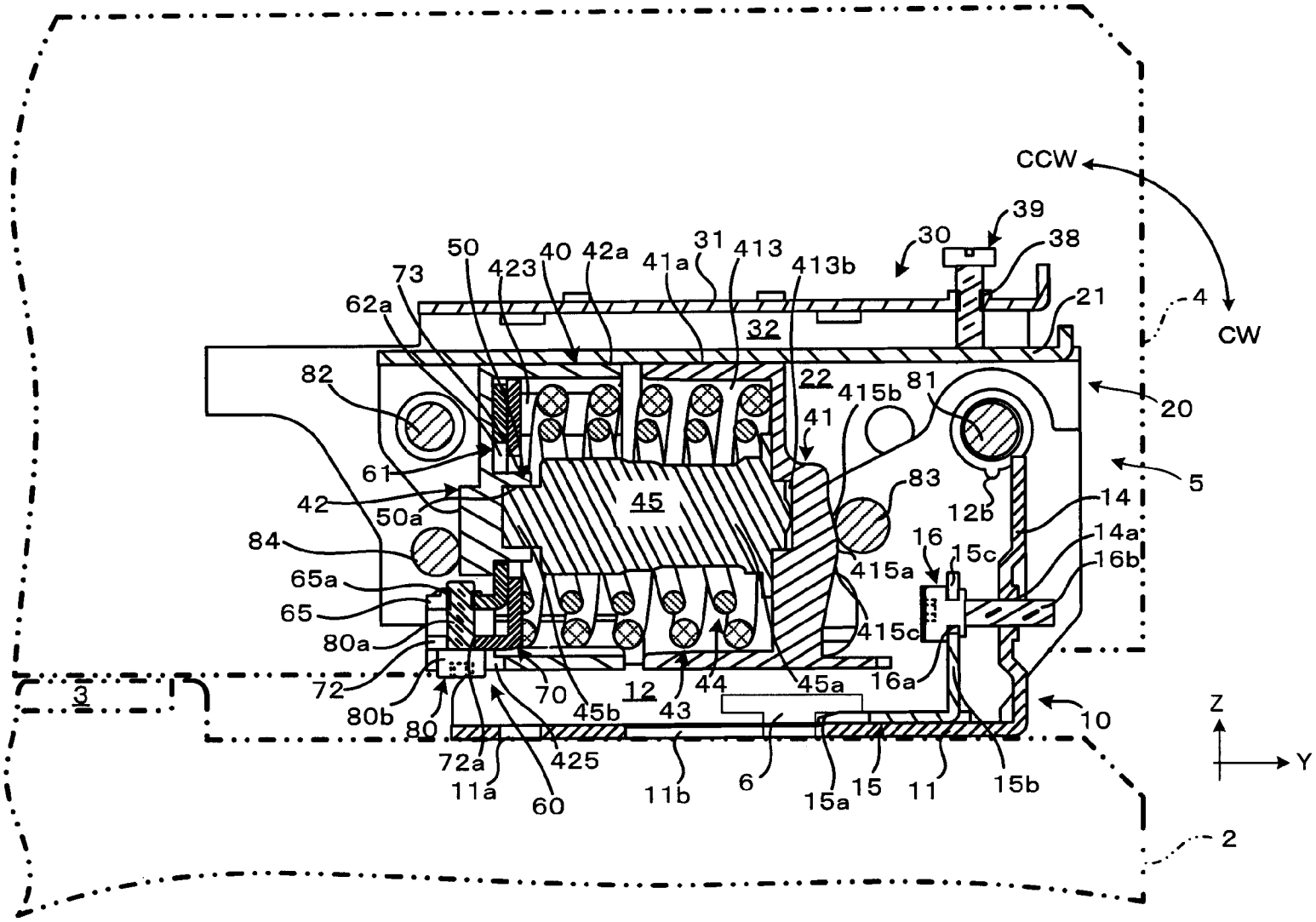
FIG. 5 shows an arrow A-A cross section of FIG. 4.

FIG. 1 shows a schematic perspective view of exterior appearance illustrating an embodiment of a copying machine equipped with a document cover closer according to the invention; FIG. 2 shows an exploded perspective view illustrating an embodiment of a document cover closer for the left-hand side, as shown in FIG. 1; FIG. 3 shows a perspective view of exterior appearance illustrating a document cover closer (in an assembled state) as shown in FIG. 2, in a fully-opened state; FIG. 4 shows an elevation view illustrating a document cover closer (in an assembled state) as shown in FIG. 2, in a fully-closed state; and FIG. 5 shows an arrow A-A cross section. In the drawings, three orthogonal axes are respectively defined as X-, Y- and Z-axis, where a right and left direction is an X-axis, a backward and forward direction is a Y-axis, and an upward and downward direction is a Z-axis. In the meantime, a front side is abbreviated to (F), and a rear side to (R).

In FIG. 1, a copying machine 1 is a piece of office equipment equipped with an image reading portion, wherein a contact glass 3 is placed on an upper portion of a copying machine main body 2 being a main body. On the upper portion of the copying machine main body 2 as well, a document cover 4 for openably and closably covering an upper surface of the contact glass 3 is disposed. The document cover 4 is attached there via a pair of document cover closers 5 disposed on the right and left on an upper portion on a rear side (back surface side) 2*b* of the copying machine main body 2, wherein each of document cover closers 5 is composed of a hinge device such that a front side of the copying machine main body 2 is opened to the outside.

(Overall Structure of Document Cover Closer 5)

Though they are both denoted with reference numerals 5, 5, document cover closers on the right and left may have an identical structure, or the right one and the left one may have a structure different from each other. In the following, reference is made only to a document cover closer 5 on the left hand side, and not to a document cover closer 5 on the right hand side.

As shown in FIG. 2, the document cover closer 5 comprises an attaching member 10 being a base, a supporting member 20, a lift member 30, an urging portion 40 and an elastic force (spring force) adjusting portion 60. The attaching member 10 is fixed to a copying machine main body 2 via an attaching button 6 (see FIG. 5) attached to the copying machine main body 2 and attaching screws (not shown). In this embodiment, the supporting member 20 and the lift member 30 constitute a document cover tiltable holding portion.

A rear end portion side of a supporting member 20 is rotatably attached to an attaching member 10 via a first hinge pin 81 being a first hinge shaft. A lift member 30 is outer-fitted onto the supporting member 20 and rotatably attached to a tip side of the supporting member 20 via a second hinge pin 82 being a second hinge shaft. A document cover 4 is fixed to the lift member 30. An urging portion 40 is internally installed inside the supporting member 20. The urging portion 40 is elastically installed between a first pressure receiving member 83 disposed on the attaching member 10 and a second pressure receiving member 84 disposed on the lift member 30. A spring force adjusting portion 60 is disposed on the urging portion 40.

As shown in FIG. 3, a lift member 30 stops at a position at which an urging force (spring force) acts on a second pressure receiving member 84, so that the lift member is urged relative to a supporting member 20 in a clockwise direction (CW direction) being an opening direction of a document cover 4, with a second pressure receiving member 84 as a fulcrum, in order to normally stop as it overlaps the supporting member 20.

When a document cover 4 is lifted from a closed state shown in FIGS. 4 and 5 in a clockwise direction (CW direction in FIG. 5), a supporting member 20 and a lift member 30 integrally rotate in a document cover closer 5, and the document cover 4 is rotated to a fully-opened position shown in FIG. 3. When the document cover 4 is pushed down from the fully-opened position shown in FIG. 3 in a closing direction, the supporting member 20 and the lift member 30 integrally rotate, with a first pressure receiving member 81 as a fulcrum, and the document cover 4 is rotated in a closing direction against an urging force of the urging portion 40.

When the document cover 4 is pushed up for opening operation and pushed down for closing operation, it has a free stop function for stopping a rotation in a closing direction by the document cover 4 or its own weight and maintaining the document cover at the position as it stops, even if the user has his hands off the document cover 4 within a predetermined angle range. When the free stop function is degraded, a spring force of the urging portion 40 increases by adjusting operation of the spring force adjusting portion 60.

When a document (not shown) placed on a contact glass 3 is thick and thus a document cover 4 is pushed down, a supporting member 20 tilting downward abuts against an upper edge of the document, which stops a tilting movement downward of a supporting member 20. When the document cover 4 is further pushed down, a lift member 30 starts to rotate in a closing direction (in a CCW direction) against an urging force of an urging portion 40, with a second hinge pin 82 as a fulcrum. Then, the document cover is pushed down, until the document cover 4 is in a contact with an upper surface of a thick document.

In this embodiment, a document cover 4 is openable and closable respectively relative to an attaching member 10 and a supporting member 20 via two hinge pins, a first hinge pin 81 and a second hinge pin 82 by a document cover holding portion composed of a supporting member 20 and a lift member 30; however, it is also possible that no lift member 30 is provided, and that a document cover 4 is fixed to the supporting member 20 and configured to be openable and closable at a single step; in this case, a second pressure receiving member 84 can be provided on a tip of the supporting member 20. In summary, whether the document cover holding portion is composed of the supporting member 20 and the lift member 30 or only of the supporting member 20, an urging portion 40 only has to apply the urging force to the document cover 4 in the opening and closing direction.

(Structure of Attaching Member 10)

Figure 6:
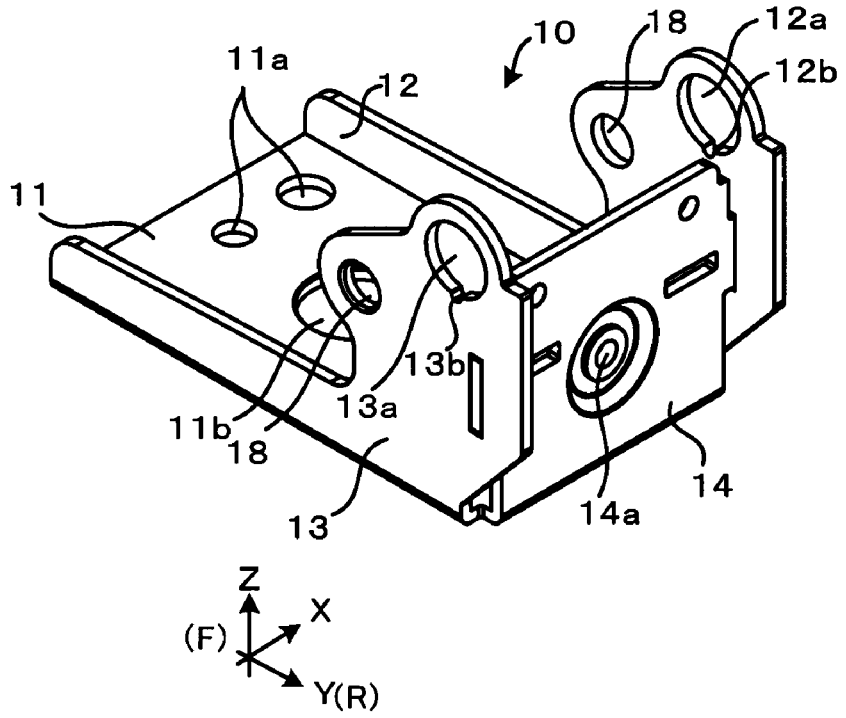
FIG. 6 shows a perspective view of exterior appearance illustrating an attaching member shown in FIG. 2, as seen from a back side.

FIG. 6 shows a perspective view of exterior appearance illustrating an attaching member shown in FIG. 2, as seen from a back side. Reference is made to structure of an attaching member 10, with reference to FIGS. 1 to 6.

An attaching member 10 comprises a bottom plate portion 11 in the shape of rectangular flat plate, a left side plate portion 12 and a right side plate portion 13 provided on the left and right sides of the bottom plate portion 11, and a back wall plate portion 14 between the left side plate portion 12 and the right side plate portion 13 and at a rear end of the bottom plate portion 11. The left side plate portion 12, the right side plate portion 13 and the back wall plate portion 14 are formed integrally with the bottom plate portion 11 by bending respective portions of the latter.

On the bottom plate portion 11, a through hole 11*a* through which a screw (not shown) is passed through is formed, as well as an engaging hole 11*b* in which two hole portions with different inner diameters communicate with each other. As shown in FIG. 5, the attaching member 10 prevents an escape in an upward and downward direction by passing an attaching button 6 on a copying machine main body 2 side through a large diameter hole of an engaging hole portion 11*b*, and then further drawing it into a small diameter hole of the engaging hole portion. There is a gap between a head portion of the attaching button 6 and a surface of a bottom plate portion 11.

If in case of each document cover 4 being equipped with an automatic document feeder (ADF) attaching positions of document cover closers 5, 5 on the right and the left are not in parallel to a main body 2, failure sometimes occurs between the ADF and the main body 2; to this end, an adjustment is made to achieve parallel attaching positions, by rotating an adjusting screw 16 from a front surface side, using jig such as driver, and thus slidably moving the height adjusting plate 15 in a forward and backward direction.

As shown in FIGS. 2 and 5, a U-shaped groove 15*c* is formed on a screw receiving plate portion 15*b* erected in an upward and downward direction on a forward and backward adjusting plate 15. Furthermore, a screw hole 14*a* corresponding to the U-shaped groove 15*c* is formed on a back wall plate portion 14. A concave groove 16*a* of a height adjusting screw 16 is fitted into the U-shaped groove 15*c*, and a screw shaft portion 16*b* is screwed into the screw hole 14*a*.

A left side plate portion 12 and a right side plate portion 13 of an attaching member 10 are formed to be bilaterally symmetrical. Shaft receiving holes 12*a*, 13*a* are formed on respective rear end portions of the left side plate portion 12 and the right side plate portion 13, so as to face each other along an X-axis direction. As shown in FIG. 6, key grooves 12*b*, 13*b* are formed on the shaft receiving holes 12*a*, 13*a* along the X-axis direction. As shown in FIG. 2, each of bearings 17*b*, each having a flange 17*a*, is installed from outside in a corresponding one of the shaft receiving holes 12*a*, 13*a*, with aligning keys (not shown) to the key grooves 12*b*, 13*b*. Each of bearings 17*b* on the right and left is inserted into the corresponding one of the shaft receiving holes 12*a*, 13*a*, until the respective flanges 17*a* abut against respective external surfaces of the left side plate portion 12 and the right side plate portion 13.

A first hinge pin 81 is passed through each of bearings 17*b* on the right and left. Washers 17*c* are respectively attached from the outside of respective bearings 17*b* to both end portions of the first hinge pin 81. Pierced end portions of the first hinge pin 81 which have passed through respective washers 17*c* pass through shaft holes 22*a*, 23*a* formed on side plates 22, 23 on the right and left of a supporting member 20, and are then fixed by caulking and so on. Therefore, the first hinge pin 81 are respectively borne by the bearings 17*b* on the right and left to rotate integrally with a supporting member 20.

First pin holes 18 to which a first pressure receiving member 83 is installed and fixed are formed further to a front surface side from shaft receiving holes 12*a*, 13*a* on respective rear end portions of left side plate portion 12 and the right side plate portion 13, so as to face each other along an X-axis direction. The first pressure receiving member 83 and a first hinge pin 81 are provided side by side. In the meantime, the first pressure receiving member 83 has a shaft-like shape in this embodiment; however, it is not limited to this shape, but may be made of resin, or a bent curved member is also applicable here.

(Structure of Supporting Member 20)

Figure 7A:
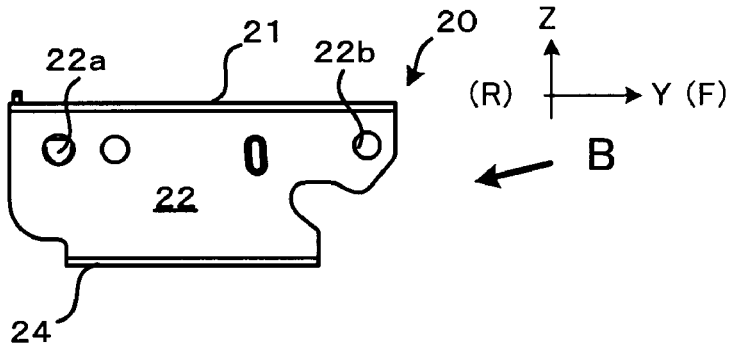
FIG. 7A is its left side view, and FIG. 7B—an arrow B perspective view of FIG. 7A.
Figure 7B:
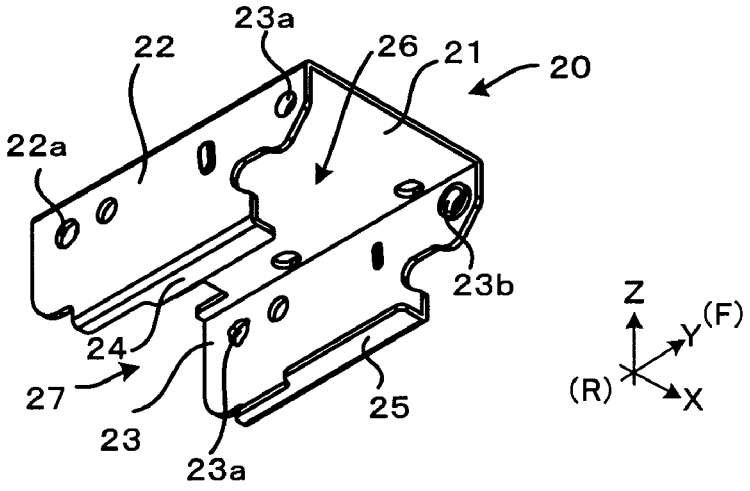
FIG. 7 shows a supporting member shown in FIG. 2, where

FIG. 7 shows a supporting member shown in FIG. 2, where FIG. 7A is its left side view, and FIG. 7B—an arrow B perspective view of FIG. 7A. Reference is made to a structure of a supporting member 20, with reference to FIGS. 1 to 7.

In FIG. 7, a supporting member 20 comprises a main body plate portion 21 formed in the shape of rectangular flat plate, a left side plate portion 22 and a right side plate portion 23 formed in a symmetrical shape on both side ends on the left and right along an X-axis direction of the main body plate portion 21, a short left guide plate portion 24 formed on a tip of the left side plate portion 22, and a short right guide plate portion 25 formed on a tip of the right side plate portion 23; the supporting member itself is thus formed substantially in the shape of rectangular parallelepiped. In FIG. 7, an inner space 26 of the supporting member 20 is formed into an urging portion housing space for slidably housing an urging portion 40 along a Y-axis direction.

A left side plate portion 22 and a right side plate portion 23 are bent inward at a right angle relative to a main body plate portion 21 to extend along a Z-axis direction. A left guide plate portion 24 and a right guide plate portion 25 are bent inward at a right angle from respective tips of the left side plate portion 22 and the right side plate portion 23, so as to face each other. An opening 27 for maintenance is formed between the left guide plate portion 24 and the right guide plate portion 25 facing each other.

A supporting member 20 is outer-fitted onto an attaching member 10, as shown in FIG. 3. On the left side plate portion 22 and the right side plate portion 23 of the supporting member 20, shaft holes 22*a*, 23*a* to which a first hinge pin 81 is fixed by caulking are formed on a rear side, and shaft bearing holes 22*b*, 23*b* facing each other for pivotally supporting a second hinge pin 82 are formed on a tip side. Both end portions of the second hinge pin 82 are fixed by caulking to shaft holes 32*a*, 33*a* formed respectively on a left side plate portion 32 and a right side plate portion 33 of a lift member 30 opposite to each other, wherein the lift member is outer-fitted onto the supporting member 20. The lift member 30 is rotatable relative to a tip side of the supporting member 20 via the second hinge pin 82 in a direction contrary to the supporting member 20, and integrally with supporting member 20, it is further rotatable relative to the attaching member 10 via the first hinge pin 81.

(Structure of Lift Member 30)

Figure 8A:
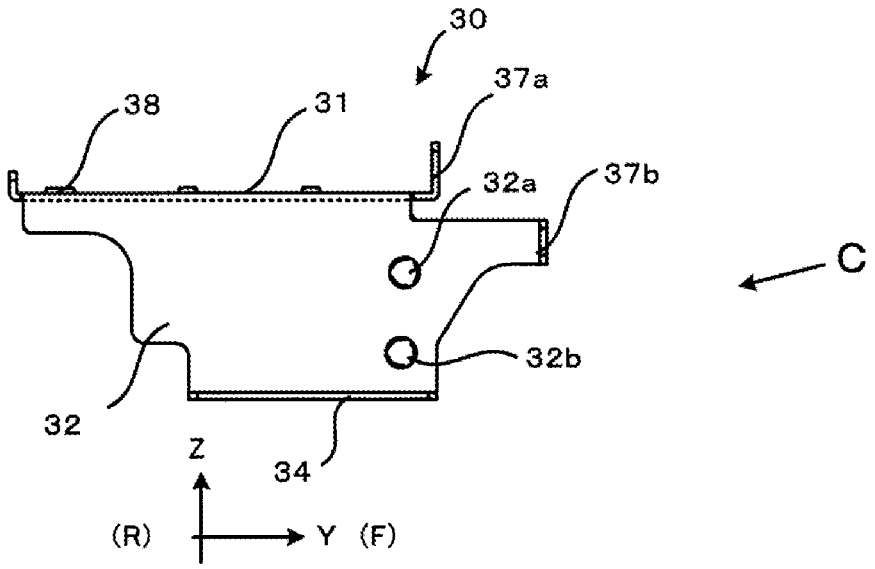
FIG. 8A is its left side view, and FIG. 8B—an arrow C perspective view of FIG. 8A.
Figure 8B:
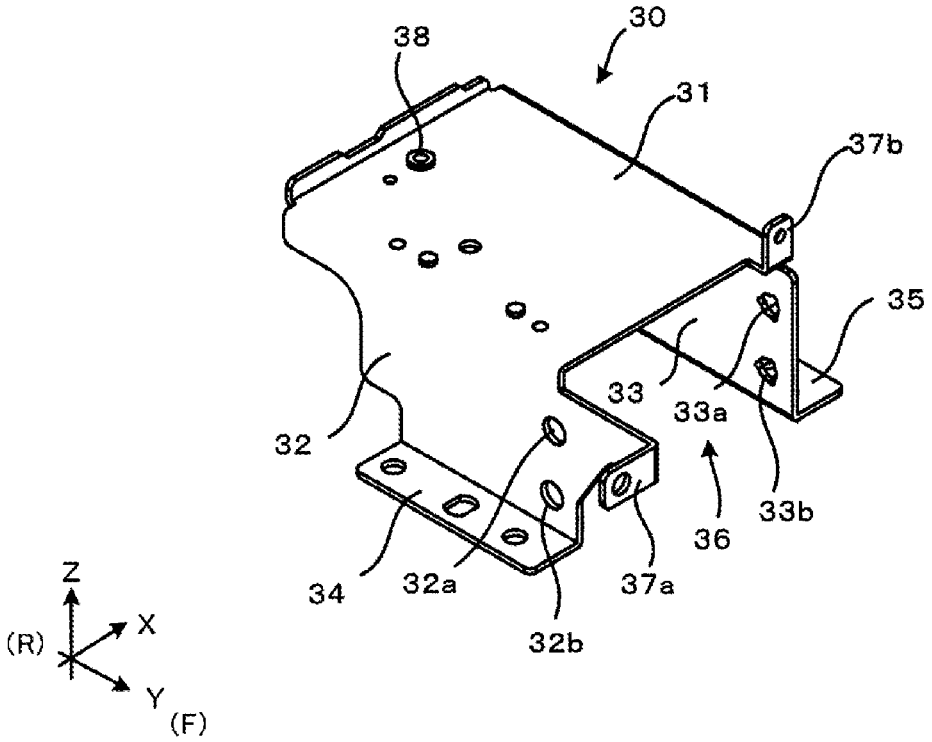
FIG. 8 shows a lift member shown in FIG. 2, where

FIG. 8 shows a lift member shown in FIG. 2, where FIG. 8A is its left side view, and FIG. 8B—an arrow C perspective view of FIG. 8A. Reference is made to structure of a lift member 30, with reference to FIGS. 1 to 8.

In FIG. 8, a lift member 30 comprises a main body plate portion 31 formed in the shape of rectangular flat plate, a left side plate portion 32 and a right side plate portion 33 formed on both side ends on the left and right along an X-axis direction of the main body plate portion 31, a short left attaching plate portion 34 formed on a tip of the left side plate portion 32, and a short right attaching plate portion 35 formed on a tip of the right side plate portion 33; the lift member itself is thus formed substantially in the shape of rectangular parallelepiped. A supporting member 20 is internally installed inside an inner space 36 of the lift member 30, and a rear end portion of a document cover 4 is attached to the main body plate portion 31, the left attaching plate portion 34 and the right attaching plate portion 35.

A left side plate portion 32 and a right side plate portion 33 are bent inward at a right angle relative to the main body plate portion 31 to extend along a Z-axis direction. A left attaching plate portion 34 and a right attaching plate portion 35 are bent outward at a right angle from respective tips of the left side plate portion 32 and the right side plate portion 33. A document cover 4 is attached to the left flange plate portion 34 and the right flange plate portion 35. Furthermore, the document cover 4 is attached to attaching pieces 37*a*, 37*b* respectively provided on a front portion of the left side plate portion 32 and a front portion of the main body plate portion 31.

A lift member 30 is outer-fitted onto a supporting member 20, as shown in FIGS. 3 and 4. On a left side plate portion 32 and a right side plate portion 33 of the lift member 30, first shaft holes 32*a*, 33*a* facing each other to which a second hinge pin 82 is fixed by caulking are formed on a front side. Furthermore, on the left side plate portion 32 and the right side plate portion 33 of the lift member 30, second shaft holes 32*b*, 33*b* to which a shaft-shaped second pressure receiving member 84 is fixed by caulking are formed on a front side. The first shaft holes 32*a*, 33*a* and the second shaft holes 32*b*, 33*b* are formed at predetermined intervals along a Z-axis direction. The first shaft holes 32*a*, 33*a* are formed between the main body plate portion 31 and the second shaft holes 32*b*, 33*b*. In the meantime, the second pressure receiving member 84 has a shaft-like shape in this embodiment; however, it is not limited to this shape, but may be made of resin, or a bent curved member is also applicable here.

A lift member 30 is outer-fitted onto a supporting member 20, and shaft end portions of a second hinge pin 82 which have passed through shaft bearing holes 22*b*, 23*b* of the supporting member 20 are fixed by caulking to first shaft holes 32*a*, 33*a*. The lift member 30 is rotatable relative to the supporting member 20 via the second hinge pin 82. Shaft end portions of a second pressure receiving member 84 are fixed by caulking to second shaft holes 32*b*, 33*b*, following an insertion of an urging portion 40 into the supporting member 20.

As shown in FIG. 8, a screw hole 38 passing through a main body plate portion 31 of a lift member 30 is provided on the main body plate portion 31. A height adjusting screw 39 is screwed with the screw hole 38, and its screw end abuts against an outer surface of a main body plate portion 21 of a supporting member 20. When the height adjusting screw 39 is further screwed, the lift member 30 is tilted integrally with a document cover 4 downward to the front, and when the height adjusting screw 39 is screwed back, the lift member 30 is tilted integrally with the document cover 4 upward to the front.

In other words, a supporting member 20 is disposed, such that it can be housed in an inner space 36, and thus a lift member 30 is rotatable relative to the supporting member via a second hinge pin 82. As stated above, except when a thick document is placed on a contact glass 3, due to a spring force of an urging portion 40, the lift member 30 integral with the document cover 4 comes to a position in which it overlaps the supporting member 20. While the document cover 4 is placed on the contact glass 3, a surface of the document cover 4 is required to be horizontal to a surface of the contact glass 3 in a upward and downward direction. To this end, an adjustment of the height adjusting screw 39 makes it possible to adjust the document cover 4 to be horizontal in the upward and downward direction.

(Structure of Urging Portion 40)

Figure 9A:
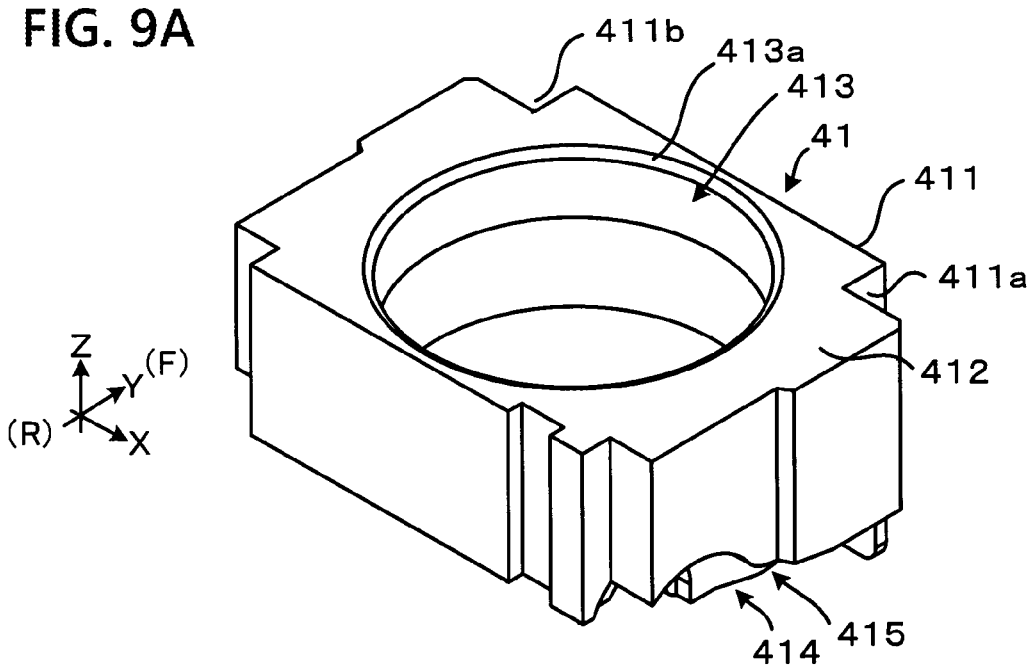
FIG. 9A is a perspective view of its exterior appearance, as seen from a back side and FIG. 9B—an arrow D perspective view of FIG. 9A.
Figure 9B:
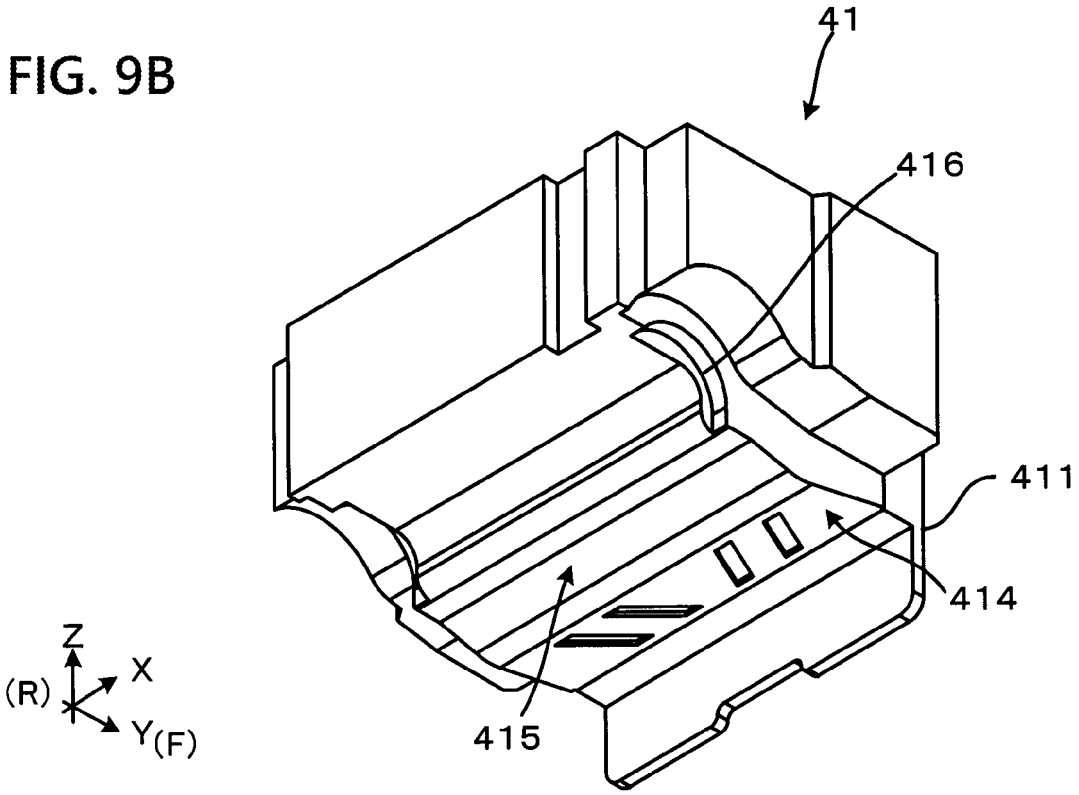
FIG. 9 shows a first spring receiving portion shown in FIG. 2, where
Figure 10A:
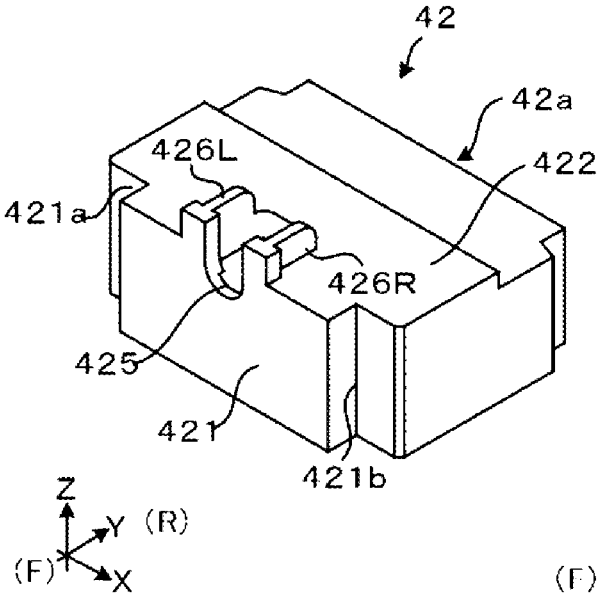
FIG. 10A is a perspective view of its exterior appearance, as seen from a front side, FIG. 10B—its bottom view, FIG. 10C—a perspective view of an inner surface on the left hand side, and FIG. 10D—a perspective view of an inner surface on the right hand side.

FIG. 9 shows a first spring receiving portion 41 shown in FIG. 2, where FIG. 9A is a perspective view of its exterior appearance, as seen from a back side and FIG. 9B—an arrow D perspective view of FIG. 9A; FIG. 10 shows a second spring receiving portion 42 shown in FIG. 2, where FIG. 10A is a perspective view of its exterior appearance, as seen from a front side, FIG. 10B—its bottom view, FIG. 10C—a perspective view of an inner surface on the left hand side, and FIG. 10D—a perspective view of an inner surface on the right hand side; Reference is made to structure of an urging portion 40, with reference to FIGS. 1 to 10.

As shown in FIG. 2, an urging portion 40 comprises a first spring receiving portion 41 being a first elastic member receiving portion, a second spring receiving portion 42 being a second elastic member receiving portion, a first coil spring 43 being an elastic member, a second coil spring 44 being an elastic member and a damper 45. The first coil spring 43 is installed inside the second coil spring 44. The first coil spring 43 has a smaller spring constant and is slightly shorter than the second coil spring 44. The damper 45 exhibits a weak or no damping effect when a piston rod 45*b* moves in an expanding direction relative to a cylinder 45*a*, and a strong damping effect when a piston rod 45*b* moves in a retracting direction relative to a cylinder 45*a*. The expression "when a piston rod 45*b* moves in an expanding direction relative to a cylinder 45*a*" refers to a phase in which a document cover is lifted in an opening direction, and that "when a piston rod 45*b* moves in a retracting direction relative to a cylinder 45*a*" refers to a phase in which a document cover is pushed down in a closing direction. In this embodiment, two coil springs, i.e. the first coil spring 43 and the second coil spring 44, are used as elastic members; however, the invention is not limited thereto, but a single coil spring may be also acceptable. Furthermore, the damper 45 can be omitted.

In the first spring receiving portion 41, engaging stepped portions 411*a*, 411*b* are formed on the right and left on the front wall portion 411 of a main body 41*a* formed substantially in the shape of rectangular parallelepiped. The engaging stepped portions 411*a*, 411*b* on the right and left are engaged with a left guide plate portion 24 and a right guide plate portion 25 of a supporting member 20. The main body 41*a* is housed inside an inner space 26 with no backlash, and slidable in a longitudinal direction (forward and backward direction) of the supporting member 20.

As shown in FIG. 9, a bottomed first spring receiving hole 413 having an opening 413*a* on the center of an upper surface 412 is formed on the main body 41*a*. Respective one end portions of the first coil spring 43 and the second coil spring 44 are inserted into the first spring receiving hole 413. Furthermore, as shown in FIG. 5, a screw portion on one end of the cylinder 45*a* being one end of the damper 45 is screwed into a screw hole 413*b* formed on an inner bottom of the first spring receiving hole 413.

An arc cam portion 415 abutting against a first pressure receiving member 83 is formed on an outer bottom wall portion 414 of the main body 41*a* of a first spring receiving portion 41. The arc cam portion 415 is formed on a cam surface projecting along a Z-axis direction, and a first cam surface 415*b* is formed to the front adjacent to a cam top 415*a*, while a second cam surface 415*c* to the rear. Furthermore, when a document cover 4 is rotated in an opening direction, a supporting member 20 is rotated in an erecting direction relative to an attaching member 10, with a first hinge pin 81 as a fulcrum. Moreover, a stopper concave portion 416 is formed on the outer bottom wall portion 414 to engage the first hinge pin 81 with the outer bottom wall portion 414 of the first spring receiving portion 41.

When a document cover 4 is closed at a fully-closed position shown in FIG. 5, a first pressure receiving member 83 provided on an attaching member 10 abuts against a first cam surface 415*b* of an arc cam portion 415 of a first spring receiving portion 41. When the document cover 4 is lifted from the fully-closed position shown in FIG. 5 in an opening direction, a supporting member 20 is rotated in a clockwise direction (CW direction), with a first hinge pin 81 as a fulcrum, and in doing so, the first cam surface 415*b* as well as the cam top 415*a* passes by the first pressure receiving member 83, so that the second cam surface 415*c* abuts against the latter.

A first cam surface 415*b* and a second cam surface 415*c* are both formed to be cam surfaces, wherein the former, when abutting against a first pressure receiving member 83, generates a reaction force on a document cover 4 in a closing direction, while the latter, when abutting against the first pressure receiving member 83, generates a reaction force on the document cover 4 in an opening direction.

Therefore, a document cover 4 is pressed toward a fully-closed position due to a spring force. Still further, when the document cover 4 is lifted in an opening direction, a cam top 415*a* passes by a first pressure receiving member 83 so that a second cam surface 415*c* abuts against the latter, the document cover 4 is tilted due to a spring force in an opening direction. The document cover 4 can be rotated in an opening direction, until a stopper concave portion 416 is engaged with a first hinge pin 81.

In a second spring receiving portion 42, engaging stepped portions 421*a*, 421*b* are formed on the right and left on a front wall portion 421 of a main body 42*a* formed substantially in the shape of rectangular parallelepiped. The engaging stepped portions 421*a*, 421*b* on the right and left of the second spring receiving portion 42 are engaged with a left guide plate portion 24 and a right guide plate portion 25 of a supporting member 30. The main body 42*a* is housed inside an inner space 26 with no backlash, and slidable in a longitudinal direction (forward and backward direction) of the supporting member 20.

Figure 10B:
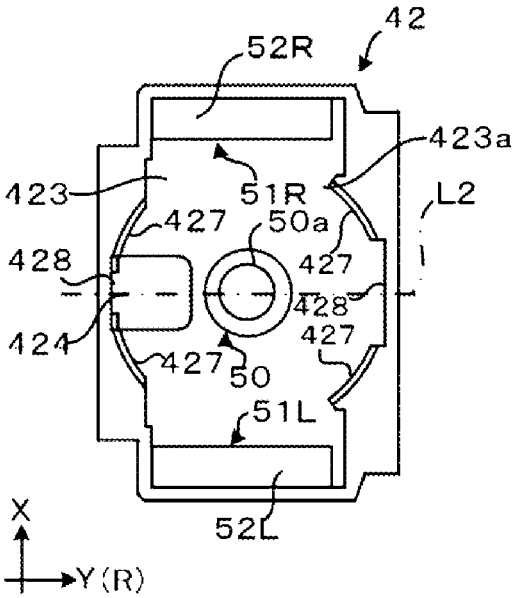
FIG. 10 shows a second spring receiving portion shown in FIG. 2, where
Figure 10C:
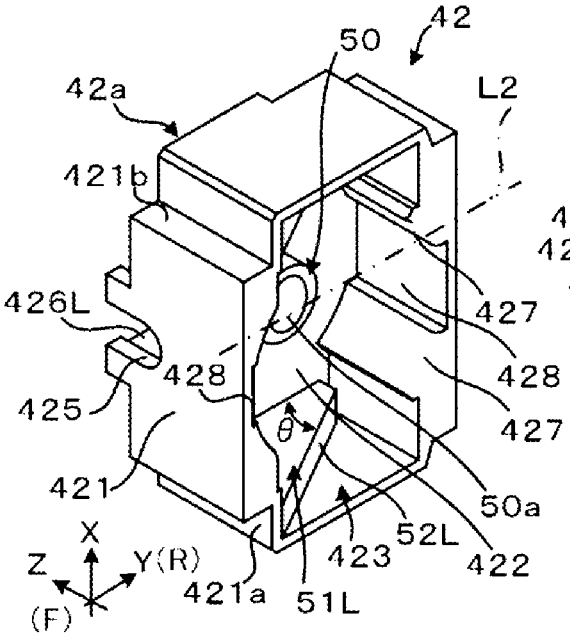
Figure 10D:
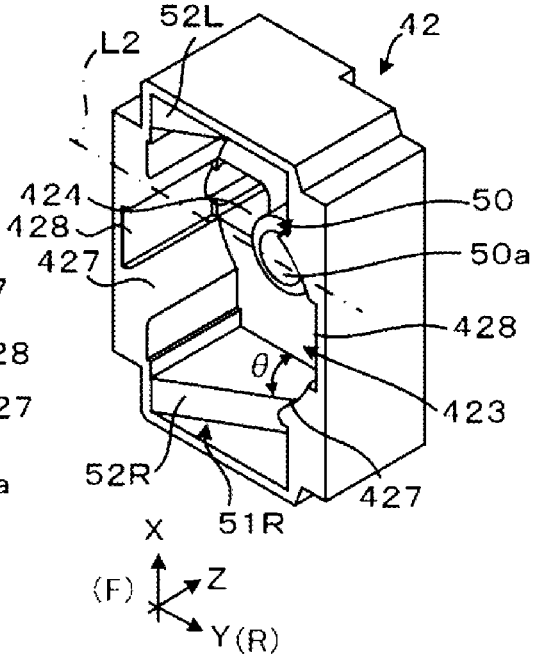

As shown in FIGS. 10B to 10D, a second spring receiving hole 423 having an opening 423*a* on a lower side, as well as an upper wall portion 422 as an inner wall, is formed on the main body 41*a*. Respective other end portions of a first coil spring 43 and a second coil spring 44 are inserted into the second spring receiving hole 423. A second spring receiving portion 42 is slidably housed in the supporting member 20, with its opening 423*a* facing an opening 413*a* of a first spring receiving portion 41.

Furthermore, a circular column-shaped damper attaching protruding portion 50 is formed on an inner surface of an upper wall portion 422 of a second spring receiving hole 423. As shown in FIG. 5, a piston rod attaching hole 50*a* is formed on the damper attaching protruding portion 50, wherein a tip of a piston rod 45*b* of a damper 45 is fitted and fixed to the piston rod attaching hole 50*a*. The second spring receiving hole 423 is a housing space for a spring force adjusting portion 60.

As a first coil spring 43, a second coil spring 44, a damper 45 and a spring force adjusting portion 60 are all disposed between a first spring receiving portion 41 and a second spring receiving portion 42, all are housed into an inner space 26 of a supporting member 20. A second pressure receiving member 84, as fixed to a lift member 30, abuts against an outer surface of an upper wall portion 422 of the second spring receiving portion 42. An urging force of an urging portion 40 is applied to the second pressure receiving member 84 via the second spring receiving portion 42.

(Structure of Spring Force Adjusting Portion 60)

Figure 11A:
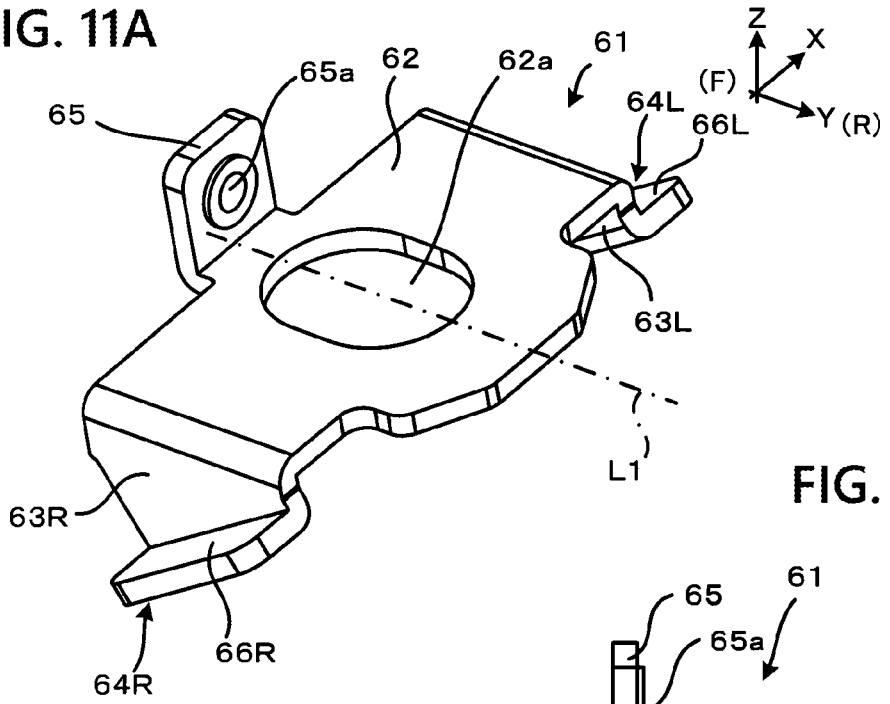
FIG. 11A is a perspective view of its exterior appearance, as seen from a back side, FIG. 11B—an arrow D view of FIG. 11A and FIG. 11C—an arrow E view of FIG. 11A.
Figure 11B:
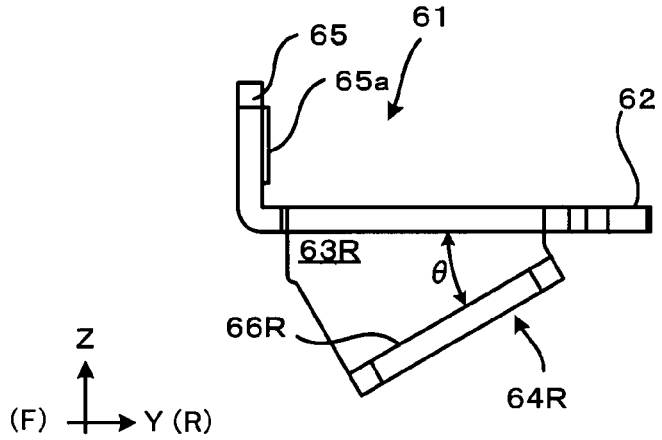
FIG. 11 shows a spring force adjusting cam plate of a spring force adjusting portion shown in FIG. 2, where
Figure 11C:
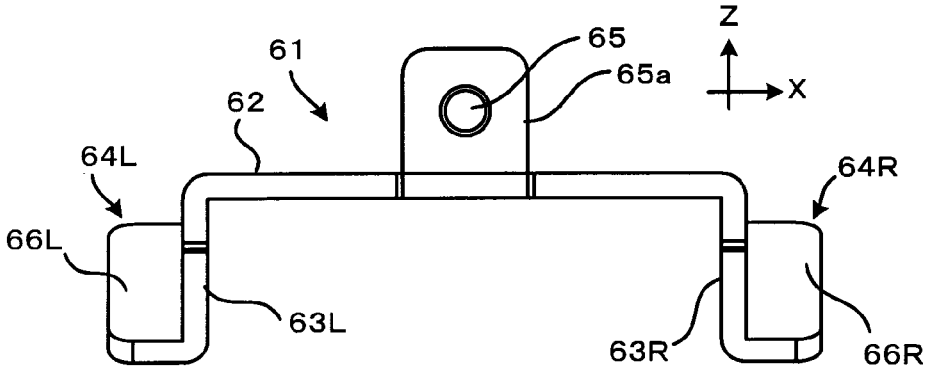
Figure 12A:
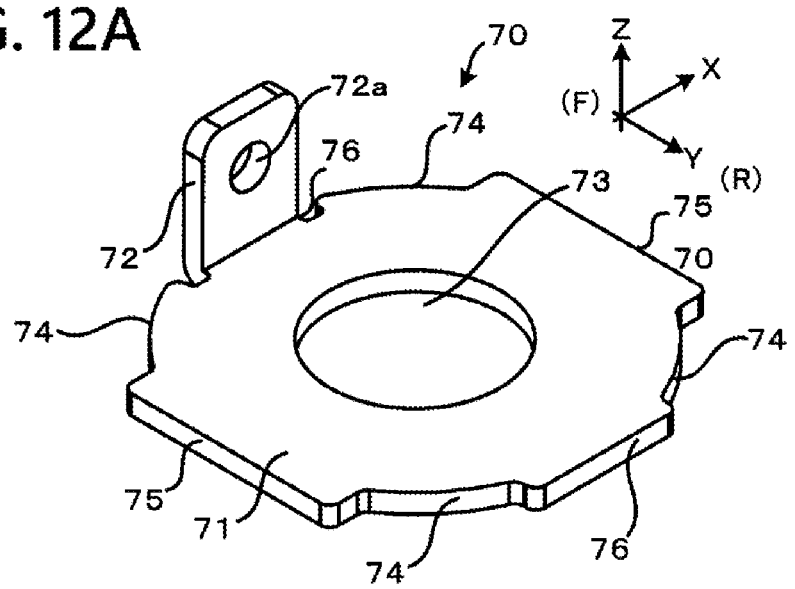
FIG. 12A is a perspective view of its exterior appearance, as seen from a back side and FIG. 12B—an arrow F view of FIG. 12A.
Figure 12B:
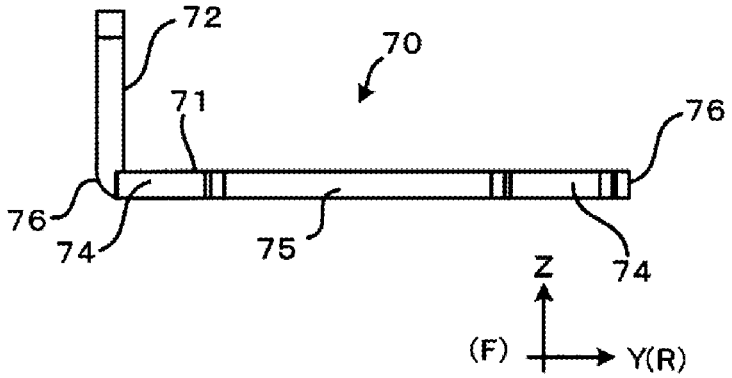
FIG. 12 shows a spring sheet plate of a spring force adjusting portion shown in FIG. 2, where
Figure 13A:
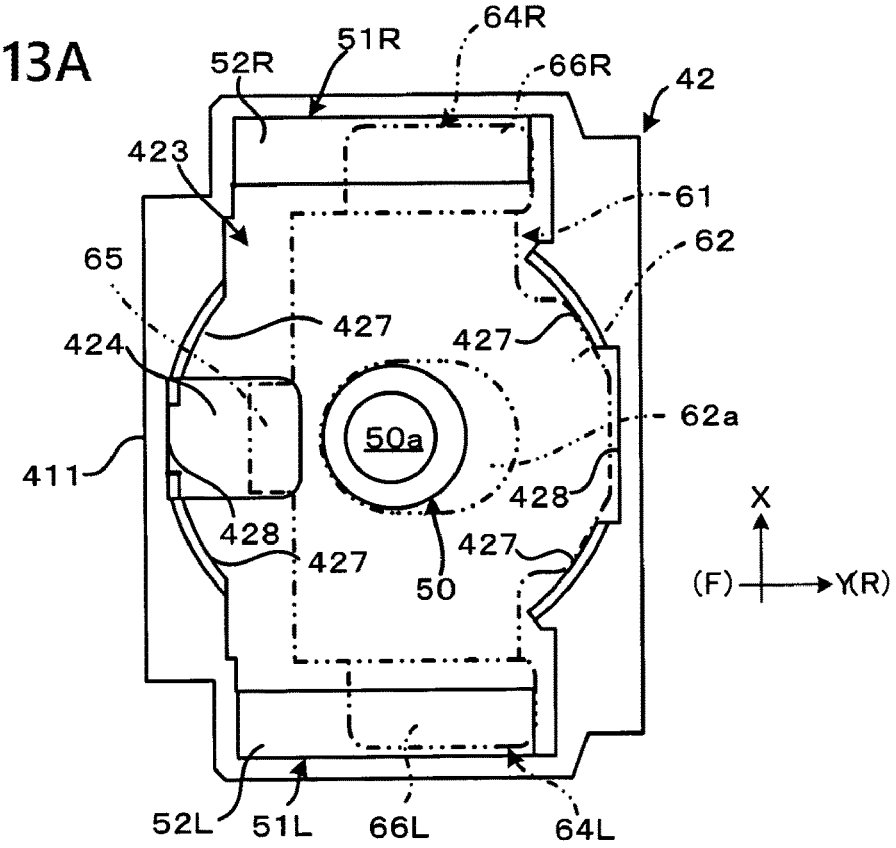
FIG. 13A shows a bottom view of a spring force adjusting cam plate as disposed at its position relative to a second spring receiving portion, and FIG. 13B—a bottom view of a spring sheet plate as disposed at its position relative to a second spring receiving portion.
Figure 13B:
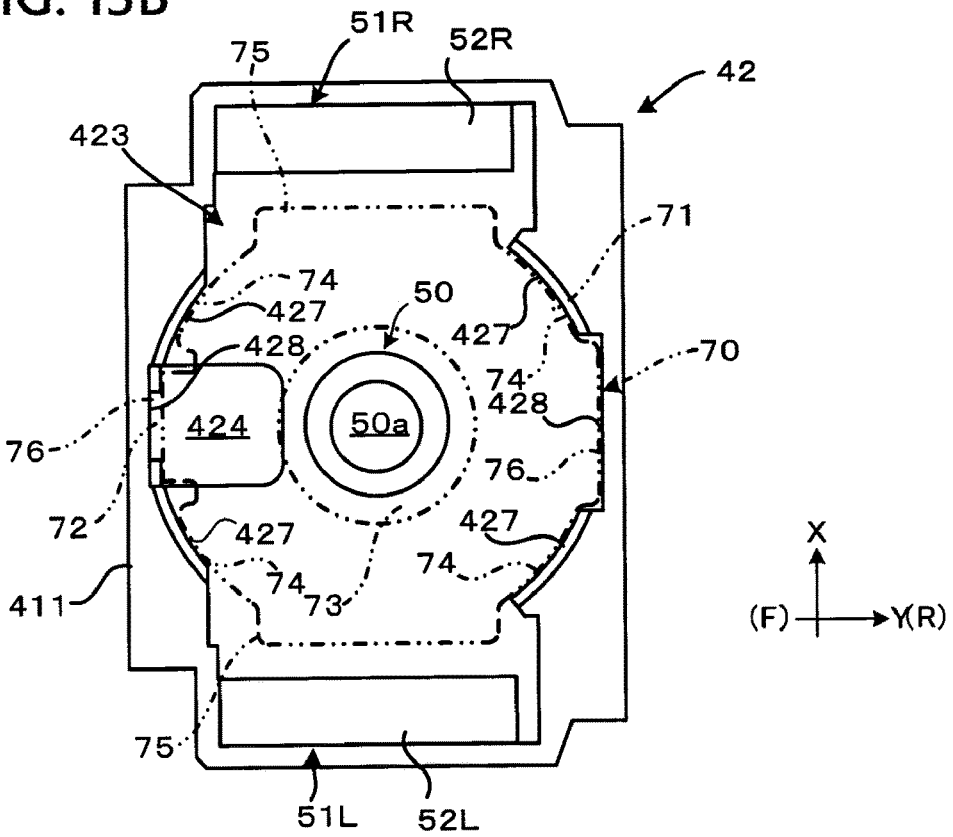

FIG. 11 shows a spring force adjusting cam plate of a spring force adjusting portion shown in FIG. 2, where FIG. 11A is a perspective view of its exterior appearance, as seen from a back side, FIG. 11B—an arrow D perspective view of FIG. 11A and FIG. 11C—an arrow E perspective view of FIG. 11A; FIG. 12 shows a spring sheet plate of a spring force adjusting portion shown in FIG. 2, where FIG. 12A is a perspective view of its exterior appearance, as seen from a back side and FIG. 12B—an arrow F perspective view of FIG. 12A; in FIG. 13, FIG. 13A shows a bottom view of a spring force adjusting cam plate as disposed at its position relative to a second spring receiving portion, and FIG. 13B—a bottom view of a spring sheet plate as disposed at its position relative to a second spring receiving portion. Reference is made to structure of a spring force adjusting portion 60, with reference to FIGS. 1 to 13.

A spring force adjusting portion 60 is composed of a second spring receiving portion 42 being a second elastic member receiving portion, a spring force (elastic force) adjusting cam plate 61, a sheet plate 70 being an elastic member sheet plate portion and a spring force adjusting screw 80.

In FIG. 11, a spring force adjusting cam plate 61 comprises a main body plate portion 62 substantially in the shape of rectangular flat plate, a left leg portion 63L and a right leg portion 63R extending downward from both sides on the right and left of the main body plate portion 62 along a Z-axis and formed in the shape substantially of triangle in a plan view, a left sliding cam plate portion 64L and a right sliding cam plate portion 64R respectively extending outward on a right and left direction from respective tilted ends of the left leg portion 63L and the right leg portion 63R, and a screw screwing piece 65 extending upward from a front end edge of the main body plate portion 62. The spring force adjusting cam plate 61 is formed to be bilaterally symmetrical with a center line L1 passing a center in a right and left direction of the main body plate portion 62 and running along a Y-axis direction as a center.

When a longitudinal direction (a sliding direction of the second spring receiving position 42) of an inner space 26 (an urging portion housing space) of a supporting member 20 is a Z-axis direction, a main body plate portion 62 of a spring force adjusting cam plate 61 is housed in a second spring receiving hole 423 of a second spring receiving hole 42. A left sliding cam plate portion 64L and a right sliding cam plate portion 64R are tilted in a Y-Z plane at a tilting angle θ relative to the main body plate portion 62. Respective upper surfaces of the left sliding cam plate portion 64L and the right sliding cam plate portion 64R are a left sliding surface 66L and a right sliding surface 66R, which are formed on tilted surfaces running down from a rear to a front. In other words, the left sliding surface 66L and the right sliding surface 66R are formed on cam surfaces having cam tracks changing their height along a spring force applying direction of an urging portion 40.

A guide hole 62*a* long in a Y-axis direction is formed on a main body plate portion 62 of a spring force adjusting cam plate 61, with a center line L1 as a center. A screw hole 65*a* into which a spring force adjusting screw 80 being an elastic force adjusting screw is screwed is formed on a screw screwing piece 65.

A spring force adjusting cam plate 61 is housed in a second spring receiving hole 423, with the guide hole 62*a* being inserted into a piston rod attaching hole 50*a* of a second spring receiving portion 42.

In FIGS. 10B to 10D, a space inside a second spring receiving hole 423 is formed to be bilaterally symmetrical with a center line L2 passing a center in a right and left direction of the main body plate portion 42 and running along a Y-axis direction as a center. A left cam portion 51L and a right cam portion 51R are formed along a forward and backward direction on respective inner circumferential side walls on the left hand side and right hand side of a damper attaching protruding portion 50. A left cam surface 52L of the left cam portion 51L and a right cam surface 52R of the right cam portion 51R are formed on tilted surfaces running downward from a rear side to a front side at tilting angle θ.

As shown in FIG. 13A, in a spring force adjusting cam plate 61 as housed in a second spring receiving hole 423, a left sliding surface 66L of a left sliding cam plate portion 64L abuts against a left cam surface 52L of a left cam portion 51L, while a right sliding surface 66R of a right sliding cam plate portion 64R abuts against a right cam surface 52R of a right cam portion 51R. FIG. 13A shows a state in which the left sliding cam plate portion 64L and the right sliding cam plate portion 64R abut against respective rear end sides of the left cam portion 51L and the right cam portion 51R, and a state in which the main body plate portion 62 of the spring force adjusting cam plate 61 abuts against a ceiling wall surface of the second spring receiving hole 423.

As shown in FIG. 10, an upper wall opening 424 is formed on a front portion of a damper attaching protruding portion 50 on a upper wall portion 422 of a second spring receiving hole 42. A U-shaped groove portion in the U-shape connected to an upper wall opening 424 is formed on a front wall portion 421 of the second spring receiving hole 42. A left guide piece 426L and a right guide piece 426R are pushed upward out of an upper surface of an upper wall portion 422 on the right and left of the upper wall opening 424.

As the spring force adjusting cam plate 61 is housed in a second spring receiving hole 423 of the second spring receiving portion 42, a screw screwing piece 65 is inserted into an upper wall opening 424. The screw screwing piece 65 is guided by a left guide piece 426L and a right guide piece 426R, and movable in a forward and backward direction and a Z-axis direction. The screw hole 65*a* of the screw screwing piece 65 faces a U-shaped groove portion 425.

When a spring force adjusting cam plate 61 moves at a predetermined interval (Y1) from a rear end position shown in FIG. 13A to the front relative to a left cam portion 51L and a right cam portion 51R, it moves downward by a predetermined height (Z1). A left leg portion 63L and a right leg portion 63R of the spring force adjusting cam plate 61 abut against an inner side surface of the left cam portion 51L and the right cam portion 51R, so that the spring force adjusting cam plate 61 is restricted in movement in a left and right direction, and its movement along a forward and backward direction and a Z-axis direction is guided.

A spring sheet plate 70 abuts against a lower surface of a main body plate portion 62 of a spring force adjusting cam plate 61, and abuts against respective other ends of a first coil spring 43 and a second coil spring 44. As shown in FIG. 12, the spring sheet plate 70 comprises a main body plate portion 71 formed in the shape substantially of square flat plate and a screw holding piece 72 extending upward in a Z-axis direction from a front end edge of the main body plate portion 71. A hole portion 73 into which a damper attaching protruding portion 50 is fitted with gap is formed on the main body plate portion 71, as well as four corner portions 74 in an arc shape. As shown in FIG. 13B, side edges 75 on the right and left of the main body plate portion 71 extends up to the inside of the left leg portion 63L and the right leg portion 63R. Furthermore, side edges 76 at the front and rear ends of the main body plate portion 71 protrude outward from the four corner portions 74.

An inner circumferential side wall surface of a second spring receiving hole 423 of a second spring receiving portion 42 is formed in conformity with an outer shape of a main body plate portion 71 of a spring sheet plate 70 (without an outer shape of side edges 75 on the right and left) to restrict movement of the spring sheet plate 70 in a forward and backward direction, and to guide movement in a Z-axis direction. Inner circumferential side wall surfaces 427 respectively corresponding to four corner portions 74 are formed in a curved concave shape, and inner circumferential side wall surfaces 428 in a forward and backward direction are formed in a concave groove shape.

A screw portion 80*a* of a spring force adjusting screw 80 is passed through a screw holding piece 72 of a spring sheet plate 70, and a screw insertion hole 72*a* engaged with a head portion 80*b* is formed. The screw holding piece 72 is inserted so as to abut against a front end inner circumferential side wall surface of an upper wall opening 424. The spring force adjusting screw 80 is inserted into the screw insertion hole 72*a* of the screw insertion piece 72, and screwed with a screw hole 65*a* formed on a screw screwing piece 65 of a spring force adjusting cam plate 61. A head portion 80*b* of the spring force adjusting screw 80 engaged with the screw insertion hole 72*a* is placed in a U-shaped groove portion 425 so as to be movable in a Z-axis direction.

In a spring force adjusting portion 60 according to this embodiment, a spring force adjusting cam plate 61 for adjusting a spring force of an urging portion 40 moves along cam tracks of a left cam portion 51L and a right cam portion 51R extending in linear shape in parallel to the spring force adjusting screw 80. The lengths of the left cam portion 51L and the right cam portion 51R can be set according to that of the second spring receiving portion 42 along a forward and backward direction. Therefore, it is possible to set a moving distance of the left cam portion 51L and the right cam portion 51R to be long, so that a spring force can be finely adjusted over a wide range.

Still further, if it is not necessary to set a fine adjustment range to be long, it is enough to reduce a length of the left cam portion 51L and the right cam portion 51R, so that it is possible to downsize a second spring receiving portion 42 and it is possible to ensure a downsizing of a document cover closer 5.

Still further, it is possible to combine an urging portion 40 with a spring force adjusting portion 60 into a single unit, to easily assemble a document cover closer and to ensure a downsizing of the document cover closer.

On the other hand, since cam portions (left cam portion 51L, right cam portion 51R) are formed using a second spring receiving portion, it is possible to ensure a downsizing of a document cover closer 5.

Still further, in a spring force adjusting cam plate 61, a screw hole 65*a* of a screw screwing piece 65 is screwed with a screw portion 80*a* of a spring force adjusting screw 80 to screw forward in accordance with a rotation of the spring force adjusting screw 80, so that it is possible to ensure a movement of the spring force adjusting cam plate 61 in a simple structure.

Due to downsizing of a document cover closer 5 according to this embodiment, it is possible to ensure a neat layout around a contact glass 3 of a copying machine main body 2.

In the following, reference is made to a spring force adjusting method of the spring force adjusting portion 60, with reference to FIGS. 14 and 15.

Figure 14:
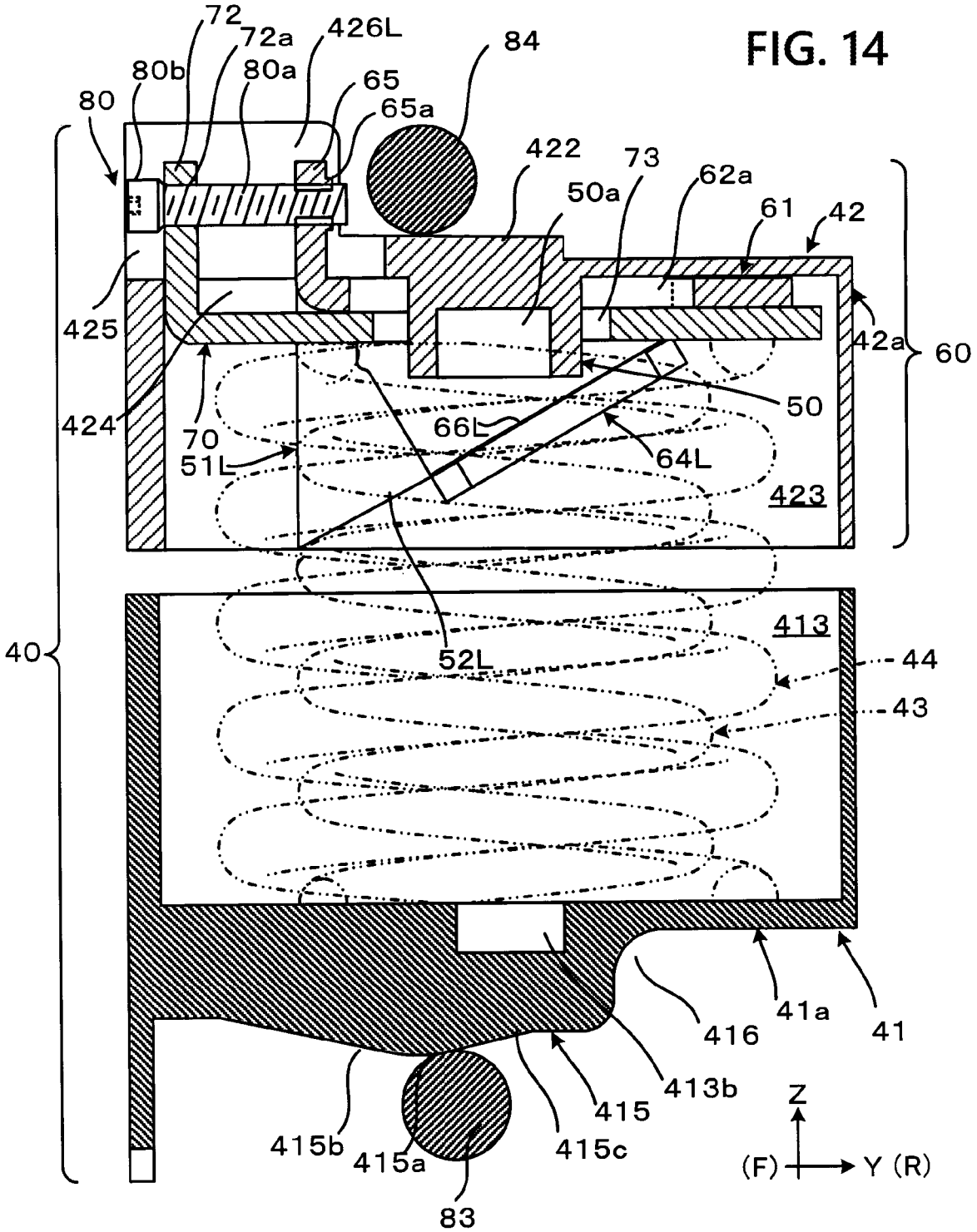
FIG. 14 shows a longitudinal cross section of a spring force adjusting portion shown in FIG. 2, more specifically illustrating a state in which a spring force is adjusted to the minimum.
Figure 15:
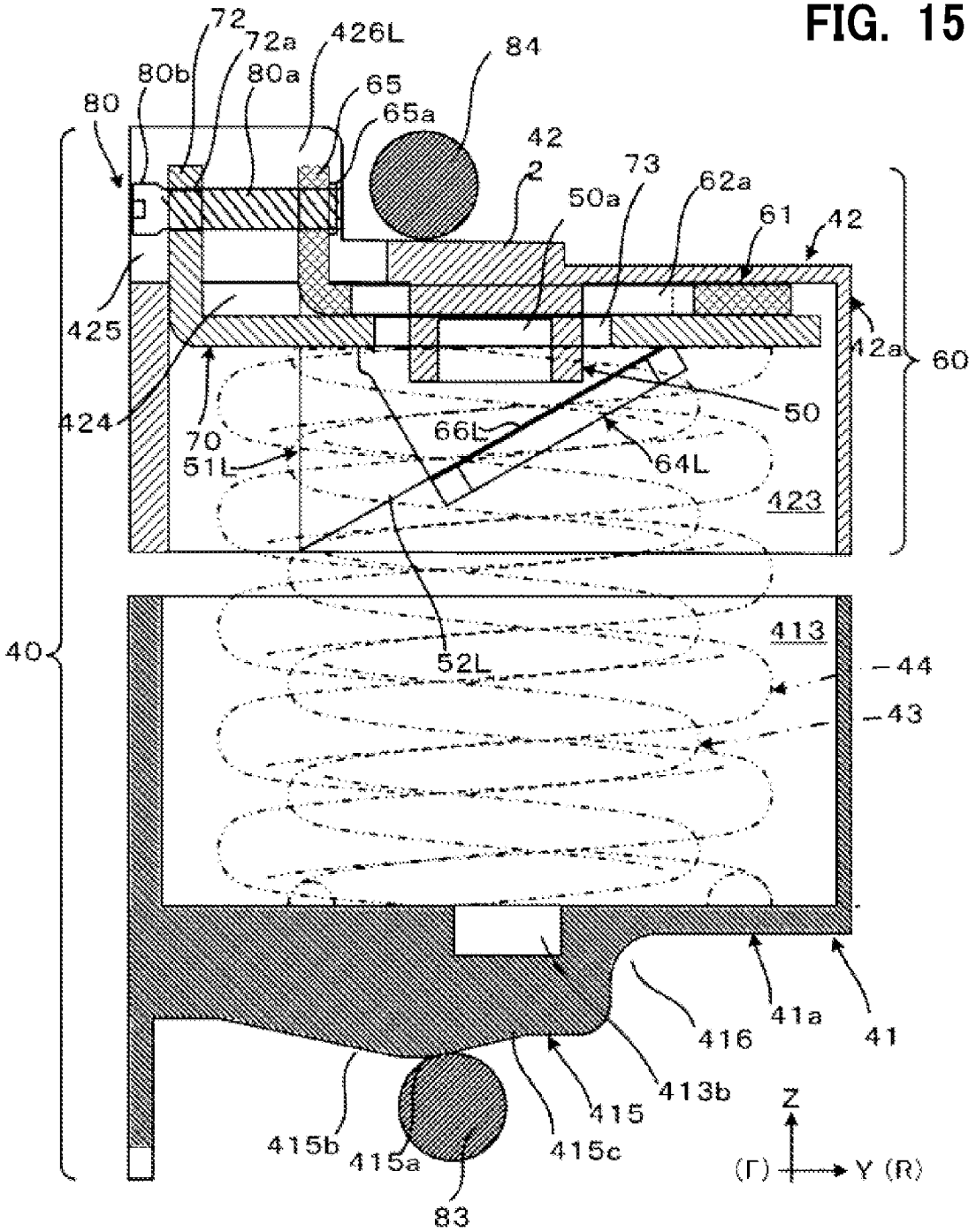
FIG. 15 shows a longitudinal cross section of a spring force adjusting portion shown in FIG. 2, more specifically illustrating a state in which a spring force is adjusted to the maximum.

FIG. 14 shows a longitudinal cross section of the spring force adjusting portion 60, more specifically illustrating a state in which the spring force is adjusted to the minimum, and FIG. 15 shows a state in which the spring force is adjusted to the maximum.

When the document cover 4 is opened e.g. to the fully-opened position, the opening 27 is provided on the front surface side of the supporting member 20, so that the head portion 80*b* of the spring force adjusting screw 80 faces the front surface of the copying machine main body 2, and it is possible to rotate the head portion 80*b* using the jig such as hexagonal wrench. As shown in FIG. 14, when the spring force adjusting screw 80 is rotated in the screwing direction relative to the screw hole 65*a*, the spring force adjusting cam plate 61 moves forward in a Y-axis direction (toward the head portion 80*b* of the spring force adjusting screw 80). Here, the spring force adjusting cam plate 61 moves along the cam tracks downward in the Z-axis direction, as the left sliding surface 66L of the left sliding cam plate portion 64L and the right sliding surface 66R of the right sliding cam plate portion 64R respectively slide on the left cam surface 52L of the left cam portion 51L and the right cam surface 52R of the right cam portion 51R.

The spring sheet plate 70 which is restricted in movement in a Y-axis direction, while sliding on the spring force adjusting cam plate 61 moving forward along a Y-axis direction and downward in a Z-axis direction, moves downward in a Z-axis direction against the spring forces of the first coil spring 43 and the second coil spring 44. Accordingly, the spring force of the urging portion 40 increases. The spring force of the urging portion 40 can be adjusted between a state in which the left sliding surface 66L and the right sliding surface 66R of the spring pressure adjusting cam plate 61 abut against the left cam surface 52L and the right cam surface 52R of the second spring receiving portion 42 at the highest position, as shown in FIG. 14, and a state in which the screw screwing piece 65 abuts against the screw insertion piece 72, as shown in FIG. 15.

In the embodiment as described above, the spring force adjusting portion 60 is disposed on the second spring receiving portion 42, but the spring force adjusting portion 60 can be disposed on the first spring receiving portion 41.

A document cover closer according to the invention is applicable to office equipment having a function of reading documents, such as copying machine, scanner, facsimile and printer.

What is claimed is:

1. A document cover closer for openably and closably attaching a document cover to a main body, said document cover closer comprising:

an attaching member (10) comprising a bottom plate portion attached to the main body, a right side plate and a left side plate provided on both sides of the bottom plate portion;

a supporting member (20) comprising a main body plate portion, a right side plate and a left side plate provided by bending the main body plate portion downward from its both side portions, as well as a right guide plate portion and a left guide plate portion provided by bending the right side plate and the left side plate inward from their respective lower end portions, the right side plate and the left side plate being rotatably attached to the right side plate and the left side plate of the attaching member via a first hinge pin (81);

a lift member (30) for holding said document cover, said lift member comprising a main body plate portion, a right side plate and a left side plate provided downward from its both side portions, as well as a right attaching plate portion and a left attaching plate portion provided outward from lower end portions of the right side plate and the left side plate, the right side plate and the left side plate being attached to the right side plate and the left side plate of the attaching member on the side of their respective free ends via a second hinge pin (82), such that the lift member is rotatable in a direction opposite to the rotational direction of said supporting member;

a first spring receiving portion (41) in contact with a first pressure receiving member attached between the right side plate and the left side plate of the attaching member and slidably provided between the right side plate and the left side plate of the supporting member;

a second spring receiving portion (42) comprising a second spring receiving hole in contact with a second pressure receiving member attached at a position at which the lift member swivels about a second hinge pin and slidably attached between the right side plate and the left side plate of the supporting member;

an elastic member (43, 44) provided between said first spring receiving portion and said second spring receiving portion; and a spring force adjusting portion (60) of the elastic member provided on said second spring receiving portion;

said spring force adjusting portion (60) comprising:

a pair of cam portions (51) respectively having a cam surface tilted in one direction and provided on both sides of the second spring receiving hole of the second spring receiving portion;

a spring force adjusting cam plate (61) having sliding cam plate portions in contact with respective cam portions on both sides, said spring force adjusting plate being slidably provided toward an upper portion from an upper wall opening (424), a screw screwing piece (65) with a screw hole provided on one end being provided on a top portion of said second spring receiving portion;

a spring sheet plate (70) having an adjusting screw attaching hole on one end and a screw holding piece (72) overlapping said screw screwing piece to protrude upward from said upper wall opening (424), said spring sheet plate being provided to overlap said elastic member in contact therewith on a lower surface of said spring force adjusting plate; and a spring force adjusting screw (80) for adjusting sliding width of said spring force adjusting plate, said spring force adjusting screw being attached to an adjusting screw hole and screwed to a screw hole of said spring force adjusting plate.

2. A document cover closer for openably and closably attaching a document cover to a main body, said document cover closer comprising:

an attaching member comprising a bottom plate portion attached to the main body and right side plate and left side plate provided on both sides of the bottom plate portion;

a supporting member comprising a main body plate portion, a right side plate and a left side plate provided by bending the main body plate portion downward from its both side portions, as well as a right guide plate portion and a left guide plate portion provided by bending the right side plate and the left side plate inward from their respective lower end portions, the right side plate and the left side plate being rotatably attached to the right side plate and the left side plate of the attaching member via a first hinge pin;

a lift member (30) for holding said document cover, said lift member comprising a main body plate portion, a right side plate and a left side plate provided downward from its both side portions, as well as a right attaching plate portion and a left attaching plate portion provided outward from lower end portions of the right side plate and the left side plate, the right side plate and the left side plate being attached to the right side plate and the left side plate of the attaching member on the side of their respective free ends via a second hinge pin, such that the lift member is rotatable in a direction opposite to the rotational direction of said supporting member;

a first spring receiving portion in contact with a first pressure receiving member attached between the right side plate and the left side plate of the attaching member and slidably provided between the right side plate and the left side plate of the supporting member;

a second spring receiving portion (42) comprising a second spring receiving hole in contact with a second pressure receiving member attached at a position at which the lift member swivels about a second hinge pin and slidably attached between the right side plate and the left side plate of the supporting member, and a damper attaching protruding portion provided to protrude on an inner top portion of said second spring receiving hole;

an elastic member provided between said first spring receiving portion and said second spring receiving portion;

a damper housed in said elastic member and provided between said first spring receiving portion and said second spring receiving portion, said damper starting to function from a predetermined closing angle of said document cover closer;

a spring force adjusting portion of the elastic member provided on said second spring receiving portion;

said spring force adjusting portion comprising:

a pair of cam portions (51) respectively having at least a cam surface tilted in one direction and provided on both sides of the second spring receiving hole of the second spring receiving portion;

a spring force adjusting cam plate having sliding cam plate portions (64) in contact with respective cam portions on both sides, said spring force adjusting plate being slidably provided toward an upper portion from an upper wall opening (424), a screw screwing piece (65) with a screw hole provided on one end being provided on a top portion of said second spring receiving portion, said spring force adjusting plate further comprising a guide hole (62*a*) into which said damper attaching protruding portion is inserted;

a spring sheet plate (70) having an adjusting screw attaching hole on one end and a screw holding piece (72) overlapping said screw screwing piece to protrude upward from said upper wall opening (424), as well as a hole portion (73) into which said damper attaching protruding portion is inserted, said spring sheet plate being provided to overlap said elastic member in contact therewith on a lower surface of said spring force adjusting plate; and a spring force adjusting screw (80) for adjusting sliding width of said spring force adjusting plate, said spring force adjusting screw being attached to an adjusting screw hole and screwed to a screw hole of said spring force adjusting plate.

3. The document cover closer according to claim 1, said spring force adjusting portion being provided on a first spring receiving portion forming said urging portion.

4. The document cover closer according to claim 1, said pair of cam portions being formed in a right and left direction inside said first spring receiving portion or said first spring receiving portion to face each other, said spring force adjusting cam plate comprising a pair of sliding cam plate portions on the right and left each having a sliding surface, said sliding surface sliding on each of cam surfaces of said pair of sliding cam plate portions on the right and left, said spring sheet plate being disposed between said pair of sliding cam plate portions on the right and left.

5. Office equipment comprising a contact glass provided on a main body, a document being put thereon, a document cover for openably and closably covering said contact glass, and a document cover closer according to claim 1 for attaching said document cover to said main body.

* * * * *